US007042156B2

(12) United States Patent
Sakamoto

(10) Patent No.: US 7,042,156 B2
(45) Date of Patent: May 9, 2006

(54) FLAT-PANEL DISPLAY DEVICE, AND PROCESS OF SEALING THE DEVICE ALONG ITS PERIPHERY

(75) Inventor: Susumu Sakamoto, Nagoya (JP)

(73) Assignee: Noritake Co., Limited, Nagoya (JP)

( * ) Notice: Subject to any disclaimer, the term of this patent is extended or adjusted under 35 U.S.C. 154(b) by 247 days.

(21) Appl. No.: 10/687,916

(22) Filed: Oct. 20, 2003

(65) Prior Publication Data

US 2004/0119397 A1 Jun. 24, 2004

(30) Foreign Application Priority Data

Oct. 24, 2002 (JP) ..... 2002-310190

(51) Int. Cl.
*H01J 17/49* (2006.01)

(52) U.S. Cl. ..... 313/583; 313/634; 313/605; 361/679; 361/736

(58) Field of Classification Search ..... 445/25, 445/24; 313/581–589, 495–497, 605, 634; 156/106; 361/679, 681, 736, 748

See application file for complete search history.

(56) References Cited

U.S. PATENT DOCUMENTS

| | | | | |
|---|---|---|---|---|
| 4,113,896 | A * | 9/1978 | Keiner et al. | 427/108 |
| 5,876,260 | A * | 3/1999 | Pepi et al. | 445/25 |
| 6,528,944 | B1 * | 3/2003 | Kishi et al. | 313/582 |
| 2002/0039004 | A1 * | 4/2002 | Kotsubo et al. | 313/582 |
| 2004/0160184 | A1 * | 8/2004 | Sun et al. | 313/582 |

FOREIGN PATENT DOCUMENTS

| | | |
|---|---|---|
| EP | 0 933 753 A2 | 8/1999 |
| JP | A 9-129143 | 5/1997 |
| JP | A 11-272209 | 10/1999 |
| JP | A 2000-285816 | 10/2000 |
| JP | A 2001-135250 | 5/2001 |
| JP | A 2001-216905 | 8/2001 |

(Continued)

OTHER PUBLICATIONS

Chizuki Tani; "Advanced Technologies of Displays"; Kyouritsu Publishing Company, first print, first edition; Dec. 28, 1998; pp. 82-84 and 101-106.

*Primary Examiner*—Edward J. Glick
*Assistant Examiner*—Elizabeth Keaney
(74) *Attorney, Agent, or Firm*—Oliff & Berridge, PLC

(57) ABSTRACT

A flat-panel display device having a transparent first plate and a second plate which are disposed in parallel with each other and cooperate to define therebetween an air-tight space in which light is generated for emission through the first plate, the display device including a sealing material for air-tightly sealing the air-tight space along a periphery of the first and second plates, and metallic thin sheets bonded with the sealing material to end faces of the first and second plates such that the metallic thin sheets cover the end faces. The display device is manufactured by applying the sealing material to the end faces such that a peripheral portion of the air-tight space is filled with a mass of the sealing material, forcing the metallic thin sheets onto the end faces such that the metallic thin sheets cover the end faces, and heating the sheets and the sealing material firing the sealing material for air-tightly bonding together the two plates while bonding the metallic thin sheets to the end faces through the sealing material.

18 Claims, 16 Drawing Sheets

FOREIGN PATENT DOCUMENTS

| | | |
|---|---|---|
| JP | A 2001-283742 | 10/2001 |
| JP | A 2001-296836 | 10/2001 |
| JP | A 2003-45345 | 2/2003 |
| JP | A 2003-506757 | 2/2003 |
| JP | A 2003-91523 | 3/2003 |
| JP | A 2003-521092 | 7/2003 |
| WO | WO 01/11420 A1 | 2/2001 |
| WO | WO 01/11421 A1 | 2/2001 |

* cited by examiner

FLAT-PANEL DISPLAY DEVICE, AND PROCESS OF SEALING THE DEVICE ALONG ITS PERIPHERY

This application is based on Japanese Patent Application No. 2002-310190 filed Oct. 24, 2002, the contents of which are incorporated hereinto by reference.

BACKGROUND OF THE INVENTION

1. Field of the Invention

The present invention relates in general to a flat-panel display device, and more particularly to improvements in a structural arrangement for and a process of sealing the device.

2. Discussion of Related Art

There are known flat-panel display devices such as a plasma display panel (PDP) and a field emission display (FED) arranged to display a desired image. Such a flat-panel display device includes a pair of flat panels at least one of which is transparent and which cooperate to define therein an air-tight space in which a gas discharge is induced to generate a ultraviolet radiation, or a cathode and a fluorescent layer are provided so that the cathode generates an electron beam that excites the fluorescent layer to generate light. The image is formed with the ultraviolet radiation or the light. An example of this type of flat-panel display device is disclosed in "Advanced Technologies of Displays", p.82–84, 101–106, Chizuka Tani, first print, first edition, Kyouritsu Publishing Company, Japan, Dec. 28, 1998.

The flat-panel display device of the type described above is used alone to display a single image, or used as each of unitary components of a so-called "tiled display" device, which uses, as the unitary components, a plurality of the flat-panel display devices that are arranged adjacent to each other and cooperate to form a large-sized screen parallel to a direction of arrangement of the flat-panel display devices. The tiled display device is required to have a spacing pitch or spacing distance between effective display areas of the adjacent flat-panel display devices, which is as small as possible, in order to improve a high degree of continuity of an image and thereby enhance a quality of the image displayed.

In the tiled flat-panel display device known in the art, however, a sealing portion is provided along the periphery or perimeter of each flat-panel display device, so that a center-to-center spacing distance between the picture elements in the adjacent flat-panel display devices tends to be considerably larger than a center-to-center spacing distance between the adjacent picture elements within each flat-panel display device. Accordingly, the known tiled flat-panel display device is not capable of displaying an image with a high degree of continuity of the image. Where the flat-panel display device is not used as each unitary component of the tiled display device, but is used alone, too, the provision of the sealing peripheral portion causes a similar problem, since it is generally desired to maximize a ratio of the size of the effective display surface area of the display device with respect to its overall external size, while minimizing the dimension of the peripheral sealing portion.

SUMMARY OF THE INVENTION

The present invention was made in view of the background art discussed above. It is a first object of the present invention to provide a flat-panel display device which has an increased ratio of the size of the effective display surface area to its overall external size. A second object of the invention is to provide a process of sealing the flat-panel display device along its periphery, so as to minimize the dimension of the peripheral sealing portion.

The first object indicated above may be achieved according to a first aspect of the present invention, which provides a flat-panel display device comprising:

a transparent first plate and a second plate which are disposed in parallel with each other and cooperate to define therebetween an air-tight space in which light is generated for emission through the first plate;

a sealing material for air-tightly sealing the air-tight space along a periphery of the first and second plates; and metallic thin sheets bonded with the sealing material to end faces of the first and second plates such that the metallic thin sheets cover the end faces.

In the flat-panel display device constructed according to the first aspect of this invention, the metallic thin sheets are bonded with the sealing material to the end faces of the first and second plates, so as to cover the end faces, so that the air tightness of the air-tight space defined between the first and second plates is increased owing to a comparatively long sealing length along which the sealing material is provided on the end faces as well as in the peripheral portion of the air-tight space. This arrangement makes it possible to reduce a required dimension of a mass of the sealing material in the peripheral portion of the air-tight space, which dimension is measured in the direction parallel to the first and second plates. Accordingly, the required degree of air tightness of the air-tight space is obtained with a relatively small thickness of a mass of the sealing material existing on the end faces of the plates. The present arrangement is effective to minimize an amount of reduction of the size of an effective display surface area of the display device due to the presence of the sealing material, and an amount of increase of the overall external size of the display device due to the presence of the sealing material outside the first and second plates. Accordingly, the present flat-panel display device has a relatively high ratio of the effective display surface area to the overall external size. The metallic thin sheets may cover substantially entire areas of the end faces of the first and second plates, as well as the mass of the sealing material in the peripheral portion of the air-tight space. However, the metallic thin sheets need not cover substantially entire areas of the end faces, and an end portion of the end face of each of the two plates which is remote from the air-tight space may be exposed. The term "metallic thin sheets" is interpreted to include sheets or tapes having a thickness of not larger than 1 mm.

In a first preferred form of the first aspect of the invention, the flat-panel display device further comprises: a plurality of internal conductors disposed between the first and second plates, each of the plurality of internal conductors having one end located near the end faces of the first and second plates; and a plurality of lead conductors provided on surfaces of the metallic thin sheets which face the end faces of the first and second plates, the plurality of lead conductors being electrically connected to the internal conductors, respectively. In the present flat-panel display device, the internal conductors provided in the display device can be electrically connected to an control circuit through the lead conductors provided on the metallic thin sheets. Thus, the lead conductors facilitate electrical connection of the internal conductors to the control circuit. In the conventional flat-panel display device, the internal conductors are connected, at the peripheries of the first and second plates, to the conductors connected to the external control circuit. To this end, electrode terminals are required at the peripheries of the plates. The provision of these electrode terminals reduces the size of the effective display surface area of the display device. In the present flat-panel display device, the internal conductors are connected to the lead conductors when the metallic thin plates are bonded to the end faces of the first and second plates, so as to seal the air-tight space along the periphery of the display device. Accordingly, the present display device does not require the terminals to be provided outside the sealing portion, for electrical connection to the external control circuit. Thus, the metallic thin sheets make it possible to further increase the ratio of the effective display surface area of the display device to the overall external size, while minimizing the required dimension of the sealing portion in the direction parallel to the first and second plates.

In one advantageous arrangement of the flat-panel display device according to the first preferred form of the invention, each of the plurality of lead conductors has one end portion which extends in a direction substantially parallel to inner surfaces of the first and second plates, toward inner portions of the first and second plates, and each lead conductor is electrically connected at the above-indicated one end portion thereof to the corresponding one of the plurality of internal conductors. This arrangement does not require the internal conductors to be formed such that one end portion of each internal conductor is located on the end face of one of the first and second plates. Accordingly, the present arrangement facilitates electrical connection of the internal conductors with the lead conductors, even where one end of each internal conductor is located in the peripheral portion of the air-tight space.

In another advantageous arrangement of the flat-panel display device according to the first preferred form of the invention, each of the metallic thin sheets has a surface covered by a layer of a dielectric material, and the plurality of lead conductors are strips of an electrically conductive material formed on the layer of the dielectric material. In this flat-panel display device, short circuiting between the lead conductors is prevented by the dielectric layer formed on each metallic thin sheet.

In a further advantageous arrangement of the first preferred form of the invention, the flat-panel display device further comprises a plurality of external conductors which are provided on a back surface of the second plate and which are electrically connected to the plurality of lead conductors, respectively. In the present flat-panel display device, the internal conductors and the external conductors are electrically connected to each other through the lead conductors, by simply bonding together the first and second plates with the sealing material and bonding the metallic thin sheets to the end faces of the first plates with the sealing material.

In a still further advantageous arrangement of the flat-panel display device of the invention, each of the metallic thin sheets is an L-shaped sheet that is L-shaped in transverse cross section and consists of two portions one of which faces the end faces of the first and second plates and the other of which faces a back surface of the second plate, each of the plurality of lead conductors being provided on one surface of the L-shaped sheet and L-shaped following the above-indicated one surface of the L-shaped sheet. In this flat-panel display device, one end portion of each lead conductor is located on the back surface of the second plate, so that the lead conductor can be easily electrically connected to an external conductor, through the above-indicated end portion of the lead conductor on the back surface of the second plate. Further, the lead conductors are backed up and covered by the L-shaped metallic thin sheets, so that the portion of each lead conductor near the edge between the end face and the back surface of the second plate is protected by the metallic thin sheet against breakage or disconnection which would result in electrical discontinuity between the internal and external conductors.

In a second preferred form of the flat-panel display device according to the first aspect of the present invention, each of the metallic thin sheets includes an end-face portion covering the end faces of said first and second plates, and a back-surface portion which extends from the end-face portion and covers a back surface of the second plate, the back-surface portion being provided for pressing contact with a heat dissipating member fixed to a frame member when the flat-panel display device is attached to the frame member. In this form of the flat-panel display device, the heat dissipating member is installed on the display device such that the heat dissipating member is held in pressing contact with the back-surface portion of the metallic thin sheets, when the display device is fixed to the frame member. Where the present flat-panel display device is used as each of unitary components of a tiled display device, the heat dissipating member can be used even after the present display device whose service life has been reached is replaced by a new one. The conventional flat-panel display device has a heat dissipating member directly bonded to the back surface of the second plate, so that the display device must be replaced with a new one, together with the heat dissipating member bonded to the second plate. Where the present flat-panel display device is used alone, the display device is fixed to the frame member, for improving the ease of handling of the display device. Where the flat-panel display device is used as each of unitary components of a tiled display device, too, the individual display devices are fixed to respective local portions of the frame member such that the display surface areas of the display devices cooperate to provide a single flat large display surface area. In either of these two cases, the display device is fixed to the frame member to which the heat dissipating member is fixed, so that the heat dissipating member can be used with a newly installed display device by which the present display device has been replaced after its service life. Preferably, the heat dissipating member is elastically biased against the back-surface portion of the metallic thin sheets of the display device fixed to the frame member, under a biasing force of a suitable biasing means such as a spring provided on the frame member.

In a third preferred form of the first aspect of this invention, the flat-panel display device further comprises an electromagnetic-wave absorbing film which is formed on a front surface of the first plate and which is connected at a peripheral portion thereof to the metallic thin sheets. In the present flat-panel display device, the electromagnetic-wave absorbing film can be easily rounded through the metallic thin sheets. Preferably, the electromagnetic-wave absorbing film is a mesh of a metallic material bonded to the front surface of the first plate, or a transparent film of an electrically conductive material formed on the front surface of the first plate. In the former case, the mesh has a comparatively high value of electric conductivity, so that the mesh may be electrically connected at one portion or a few portions thereof to the metallic thin sheets. In the latter case, the transparent film of the electrically conductive material has a comparatively low value of electrical conductivity, so that the transparent film is required to be electrically connected at a relatively large number of portions thereof to the metallic thin sheets. The electromagnetic-wave absorbing film desirably has a surface area slightly smaller than that of the front surface of the first plate. In this case, each metallic thin sheet is preferably L-shaped in transverse cross section, and consists of two portions one of which faces the end faces of the first and second plates and the other of which faces the front surface of the first plate and at least partially overlaps with the electromagnetic-wave absorbing film. This arrangement does not require the electromagnetic-wave absorbing film to be bent at the periphery of the first plate, for electrically connection with the metallic thin sheets, and eliminates a problem of warpage of the electromagnetic-wave absorbing film at its peripheral portion, and a problem of distortion of an image displayed at the peripheral portion of the display device.

The flat-panel display device according to the first aspect of this invention is suitable used as each of unitary components of a large-sized tiled display device wherein a plurality of flat-panel display devices are arranged to provide a single flat display surface. Since the flat-panel display device of the present invention has a relatively large effective display surface area with respect to the overall external size, the tiled display device consisting of a plurality of the flat-panel display devices of the invention as the unitary components does not suffer from a large difference between the center-to-center pitch of picture elements within each flat-panel display device and the center-to-center pitch of picture elements within the adjacent flat-panel display devices. Accordingly, the tiled display device does not have visually disturbing or perceptible seams at the boundaries of the adjacent flat-panel display devices, and is capable of displaying a large-sized image with high quality.

The second object indicated above may be achieved according to a second aspect of the present invention, which provides a process of manufacturing a flat-panel display device comprising a transparent first plate and a second plate which are disposed in parallel with each other and cooperate to define therebetween an air-tight space which is air-tightly sealed along a periphery of the first and second plates and in which light is generated for emission through the first plate, the process comprising the steps of:

applying a sealing material to end faces of the first and second plates such that a peripheral portion of the air-tight space is filled with a mass of the sealing material;

forcing metallic thin sheets onto the end faces of the first and second plates such that the metallic thin sheets cover the end faces; and heating the metallic thin sheets and the sealing material to fire the sealing material for air-tightly bonding together the first and second plates, and bonding the metallic thin sheets to the end faces through the sealing material, to thereby air-tightly seal said air-tight space along its periphery.

In the process of manufacturing the flat-panel display device according to the second aspect of this invention, the sealing material applied to the end faces of the first and second plates is squeezed between the end faces and the metallic thin sheets when the metallic thin sheets are forced onto the end faces. When the metallic thin sheets and the sealing material are subsequently heated, the sealing material is fluidized, and the fluidized sealing material flows and further spreads in a gas between the metallic thin sheets and the end faces, owing to a capillary phenomenon, so that the end faces of the first and second plates are covered by the metallic thin plates bonded thereto with the sealing material, and the air-tight space is air-tightly sealed along its periphery, over a relatively large sealing length along which the sealing material is provided on the end faces as well as in the peripheral portion of the air-tight space. Accordingly, the present process makes it possible to reduce the required dimension of a mass of the sealing material present in the peripheral portion of the air-tight space as measured in the direction parallel to the inner surfaces of the first and second plates, and the required thickness of a mass of the sealing material on the end faces of the plates, while assuring a required degree of air tightness of the air-space. Thus, the mass of the sealing material in the peripheral portion of the air-tight space does not cause a considerable decrease of the size of the effective display surface area of the display device, and the mass of the sealing material on the end faces does not cause a considerable increase of the overall external size of the display device. Accordingly, the flat-panel display device manufactured by the process of the invention has a comparatively high ratio of the size of the effective display surface area to the overall external size.

In one preferred form of the process according to the second aspect of this invention, each of the metallic thin sheets is provided with a plurality of perforations through which an excess portion of a mass of the sealing material initially existing between the metallic thin sheet and the end faces of the first and second plates is moved outwardly of the each metallic thin sheet. If the sealing material is applied to the end faces of the first and second plates in an excessively large amount, the excess portion of the mass of the sealing material existing between each metallic thin sheet and the end faces of the plates can be moved through the perforations outwardly of the metallic thin sheet, when the metallic thin sheet is forced on the end faces during heating of the sheet and the sealing material for sealing the air-tight space. Accordingly, the perforations function to optimize the amount of the sealing material staying between the end faces and the metallic thin sheet, thereby minimizing an amount of increase of the overall external size of the display device due to an excessively large thickness of the sealing material existing between the end faces of the first and second plates and the metallic thin sheets.

In one advantageous arrangement of the above-indicated preferred form of the second aspect of the invention, the process further comprises a step of removing the excess portion of the mass of the sealing material which has been moved through the perforations outwardly of each metallic thin sheet, after the step of heating the metallic thin sheets and the sealing material to fire the sealing material. An increase of the overall external size of the display device due to an excessively large amount of the sealing material moved through the perforations onto the metallic thin sheets can be prevented by removing the mass of the sealing material staying on the metallic thin sheets after the heating step.

In another preferred form of the second aspect of the invention, the step of applying the sealing material to the end faces of the first and second plates and the step of forcing the metallic thin sheets on the end faces are performed substantially concurrently by forcing the metallic thin sheets each coated on one surface thereof with the sealing material onto the end faces of the first and second plates. In this form of the process, the end faces of the first and second plates are coated with the sealing material when the metallic thin sheets are forced onto the end faces. Further, the dimension of the mass of the sealing material existing in the peripheral portion of the air-tight space in the direction parallel to the plates can be made smaller than where the sealing material is directly injected into the peripheral portion of the air-tight space.

In a further preferred form of the second aspect of the invention, the process further comprises a step of forming a layer of a dielectric material on one surface of each of the metallic thin sheets, and a plurality of strips of an electrically conductive material on the layer of the dielectric material, before the step of applying the sealing material, the strips being fired into a plurality of lead conductors in the step of heating the metallic thin sheets and the sealing material. In this form of the process, the lead conductors for electrically connecting internal conductors to an external device can be formed when the strips of the electrically conductive material are fired in the step of heating the metallic thin sheets forced onto the end faces of the first and second plates. Further, the thus formed lead conductors can be electrically connected to the internal conductors when the metallic thin sheets are forced onto the end faces. The layer of the dielectric may be fired before the strips of the electrically conductive material are formed on the fired dielectric layer. However, it is possible to first coat each metallic thin sheet with a paste of the dielectric material, then apply a paste of the electrically conductive material in a predetermined pattern of strips to a dried layer of the paste of the dielectric material, and finally fire the pastes of the dielectric material and the electrically conductive material to concurrently form the dielectric layer and the lead conductors.

BRIEF DESCRIPTION OF THE DRAWINGS

The above and other objects, features, advantages and technical and industrial significance of the present invention will be better understood by reading the following detailed description of presently preferred embodiments of the invention, when considered in connection with the accompanying drawings, in which.

DETAILED DESCRIPTION OF THE PREFERRED EMBODIMENT

There will be described in detail some embodiments of this invention, referring to the accompanying drawings.

Figure 1:
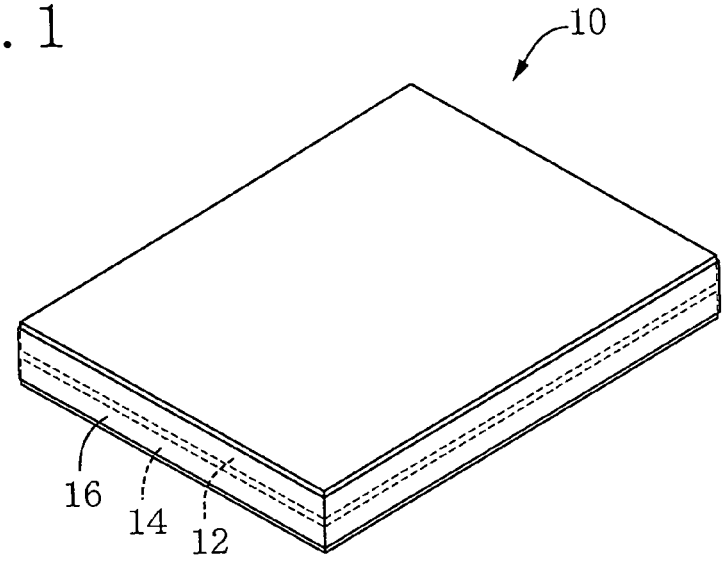
FIG. 1 is a perspective view showing an entirety of a flat-panel display device in the form of a plasma display panel (PDP) constructed according to one embodiment of this invention.

Referring first to the perspective view of FIG. 1, there is shown a flat-panel display device in the form of a plasma display panel (PDP) 10 of AC type constructed according to one embodiment of this invention. The PDP 10 is used as each of multiple unitary components of a tiled display device. That is, the tiled display device uses multiple PDPs 10 that are arranged adjacent to each other and cooperate to form a large-sized screen parallel to a direction of arrangement of the PDPs 10. Each PDP 10 includes a front plate 12 and a back plate 12 which are parallel and opposed to each other with a relatively small distance therebetween and cooperate to define therebetween an air-tight space that is air-tightly sealed at four end faces of each of the front and back plates 12, 14, with four metallic thin sheets in the form of metallic tapes 16.

Each of the front and back plates 12, 14 used for the PDP 10 is formed of a suitable transparent glass material such as a soda-lime glass, which has a softening point of about 700° C. These front and back plates 12, 14 are square plates having four sides each having a length of about 192 mm, and a uniform thickness within a range of 1.1–2.8 mm, for instance, about 1.8 mm. Each of the metallic tapes 16 is formed of an alloy 42-6 (ASTM F31-68) which has coefficient of thermal expansion close to that of a glass, a thickness within a range of 50–200 μm, for example, a thickness of about 100 μm, and a width and a length determined depending upon the dimensions of each end face of the PDP 10, for example, a thickness equal to a sum of the thickness values of the two plates 12, 14 (namely, within a range of 2.2–5.6 mm, for example, about 3.6 mm), and a length of about 192 mm which is equal the length of each side of the plates 12, 14. In the present embodiment, the four metallic tapes 26 each having the length equal to that of each side of the plates 12, 14 are separately bonded to the respective four end faces of the PDP 10. The front plate 12 functions as a first flat plate, while the back plate 14 functions as a second flat plate.

Figure 2:
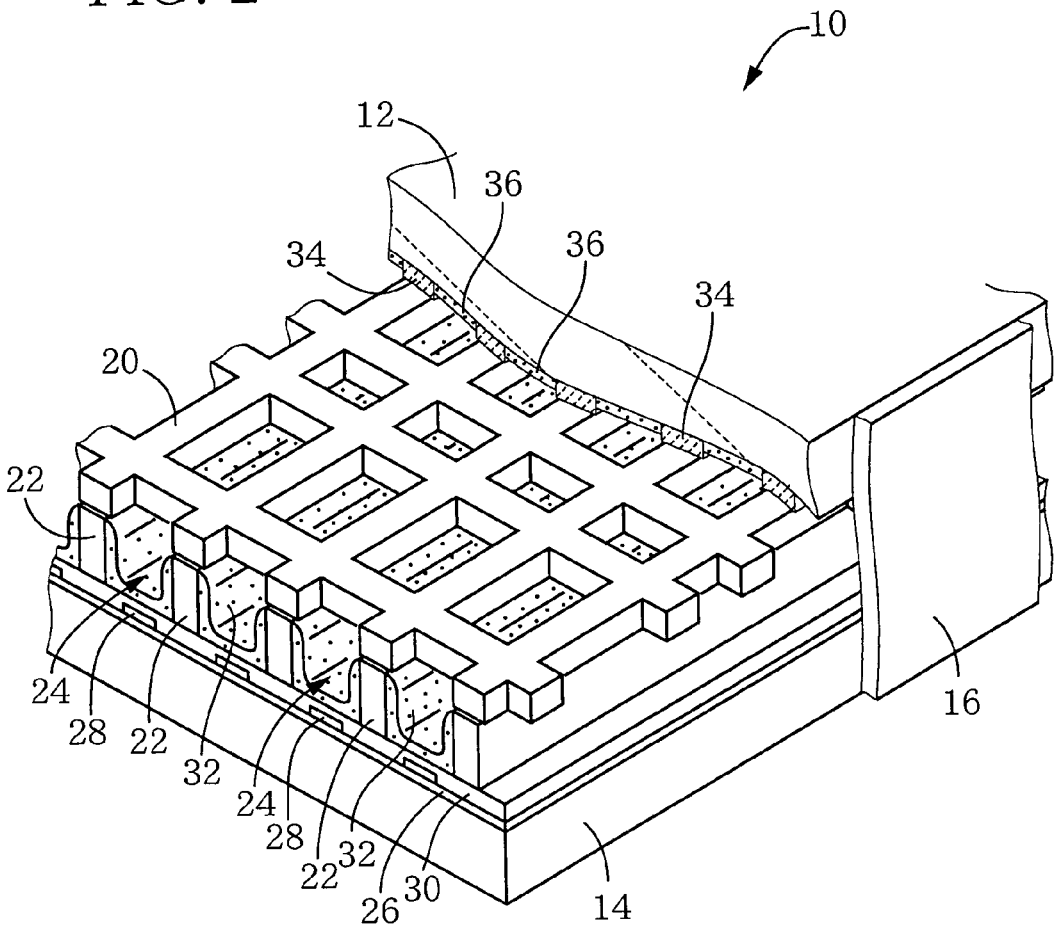
FIG. 2 is a fragmentary perspective view of the PDP of FIG. 1, which is partly cut away to show in the interior arrangement of the PDP.

Referring next to the partly cut-away perspective view of FIG. 2, the PDP 10 is provided with a plurality of parallel elongate partition walls 22 formed on the inner surface of the back plate 14 such that the partition walls 22 are spaced apart from each other by a center-to-center distance of about 1 mm, for example, in one direction, so that the above-indicated air-tight space defined between the front and back plates 12, 14 is divided into a plurality of parallel elongate discharge channels 24. Each partition wall 22 is formed, by a thick-film forming technique, of a composition whose major component is a glass material having a relatively low softening point, such as $PbO—B_2O_3—SiO_2—Al_2O_3—ZnO—TiO_2$. The partition wall 22 has a width of about 80–200 μm (measured in a direction parallel to the back plate 14) and a height of about 30–100 μm. The composition of the partition wall 22 includes an inorganic filler such as alumina, and an inorganic pigment, in suitable amounts, in order to give the partition wall 22 desired values of density and strength and to improve the formability of the composition into a desired configuration.

Between the upper end faces of the partition walls 22 on the back plate 14 and the inner surface of the font plate 12, there is formed a grid member 20 in the form of a grid or lattice consisting of first elongate walls and second elongate walls that are perpendicular to each other, such that the first elongate walls extend in the direction of extension of the partition walls 22. Thus, the partition walls 22 and the grid member 20 are formed within the air-tight space between the front and back plates 12, 14. The front and back plates 12, 14 are bonded together by the partition walls 22 and the grid member 20 formed on the partition walls 22.

The inner surface of the back plate 14 is covered over a substantially entire area thereof by an undercoat 26 formed of a low-alkali glass or a non-alkali glass. On this undercoat 26, a plurality of individual writing electrodes 28 are formed of silver by a thick-film forming technique, so as to extend in the longitudinal direction of the partition walls 22, such that the individual electrodes 28 are aligned with the respective discharge channels 24, and each electrode 28 is interposed between the adjacent partition walls 22. These individual electrodes 28 are covered by an overcoat 30 formed of a low-softening-point glass and an inorganic filler such as white titanium oxide (titania). The partition walls 22 are formed on the overcoat 30.

The inner surface of the overcoat 30 and the side surfaces of the partition walls 22 are covered by fluorescent layers 32 which correspond to the respective discharge channels 24. The adjacent three fluorescent layers 32 are formed of respective fluorescent materials that are excited by a ultraviolet radiation, to generate respective red (R), green (G) and blue (B) lights, respectively. The fluorescent layers 32 have suitable thickness values that are selected within a range of about 10–20 μm, depending upon the colors of the lights generated. Thus, the adjacent discharge channels 24 are provided with the fluorescent layers 32 of the respective three different colors (R, G, B). The undercoat 26 and the overcoat 30 are provided to prevent a reaction between the individual electrodes 28 formed of silver and the back plate 14, and contamination of the fluorescent layers 32.

On the inner surface of the front plate 12, there are formed a plurality of parallel partition strips 34 aligned with the respective partition walls 22. The partition strips 34 are formed of a material similar to that of the partition walls 22, and have a thickness of about 20–50 μm, for example. The partition strips 34 formed on the inner surface of the front plate 12 are spaced from each other by parallel fluorescent strips 36 each interposed between the adjacent strips 34. Each of the fluorescent strips 36 has a thickness within a range of about 5–15 μm. The adjacent three fluorescent strips 36 generate respective lights of the same colors as those generated by the corresponding fluorescent layers 36 formed in the respective discharge channels 24. The thickness of the partition strips 34 is determined to be larger than that of the fluorescent strips 36, in order to prevent the grid member 20 from contacting the fluorescent strips 36.

Figure 3:
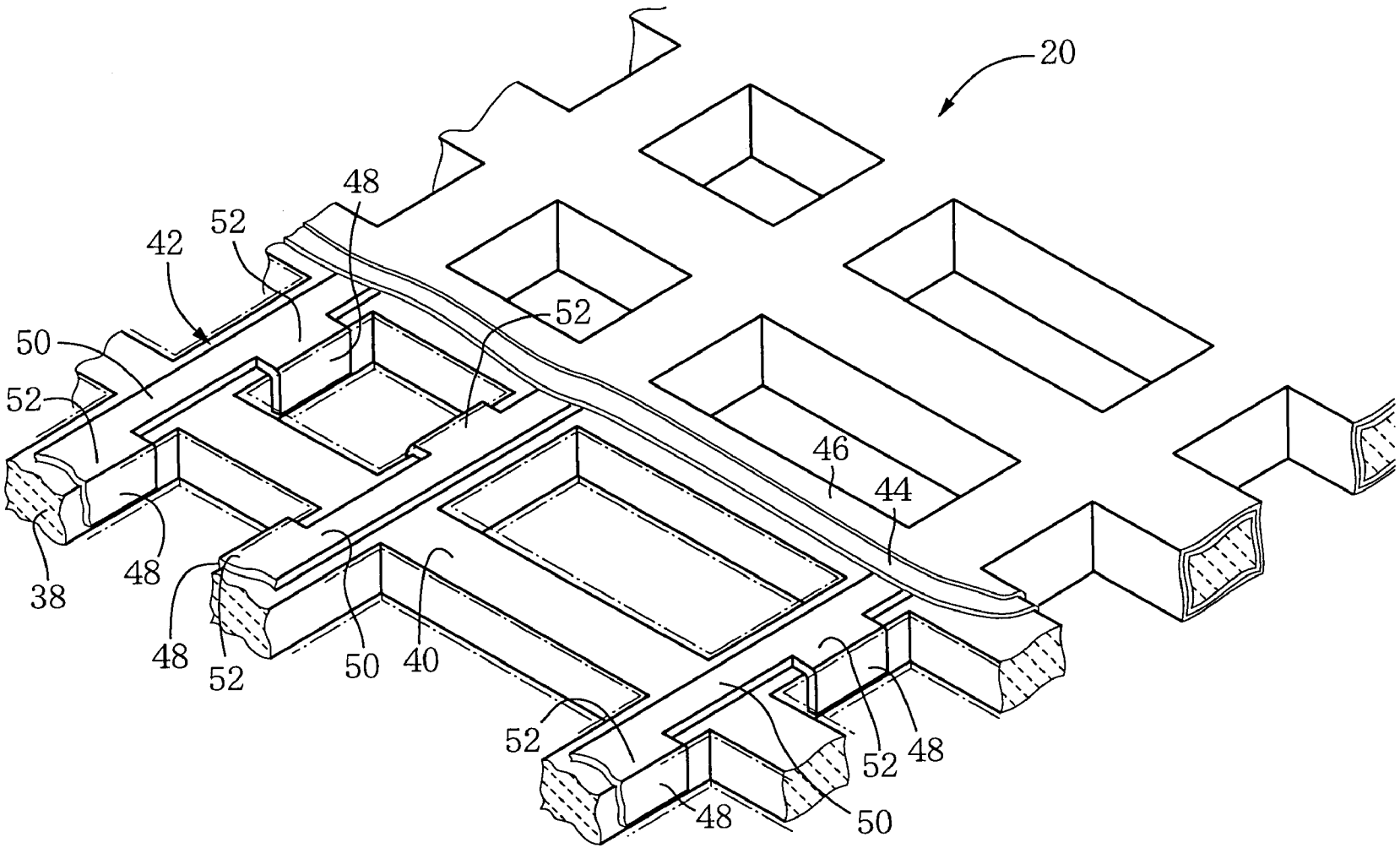
FIG. 3 is a fragmentary partly cut-away view of a grid member formed within the PDP of FIG. 1 by a thick-film forming technique.
Figure 4:
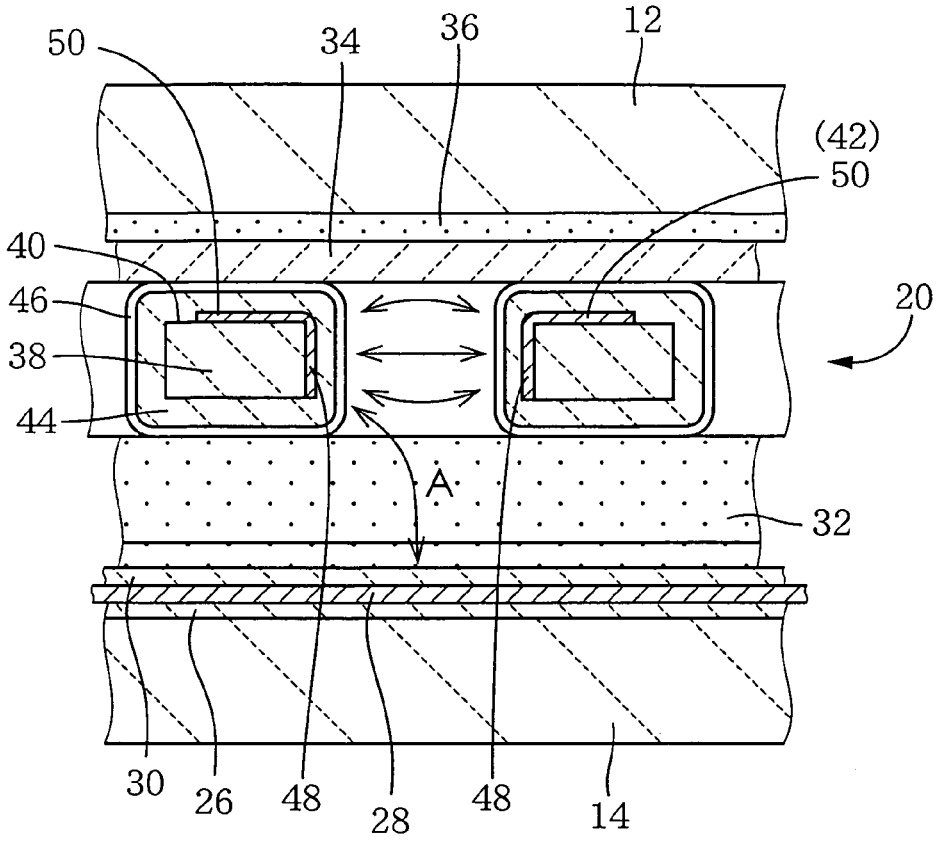
FIG. 4 is a fragmentary cross sectional view for explaining an operation of the PDP of FIG. 1.

Referring further to the partly cut-away perspective view of FIG. 3, the grid member 20 consists of a dielectric core structure 38 in the form of a grid or lattice, a conductive pattern 42 formed on an upper surface 40 of the dielectric core structure 38, a covering dielectric layer 44 covering the conductive pattern 42, and a protective film 46 which covers the covering dielectric layer 44 and which provides a surface portion of the grid member 20, as also shown in FIG. 4.

The dielectric core structure 38 has a thickness within a range of about 30–50 μm, for example, about 40 μm, and has first and second partition walls corresponding to the above-described first and second elongate walls of the grid member 20. These partition walls have a width almost equal to that of the partition walls 22, or slightly larger than that of the partition walls 22 by a suitable amount of alignment margin. For instance, the width of the partition walls of the core structure 38 is selected within a range of about 100–150 μm. The core structure 38 is formed by a thick-film forming technique of a dielectric composition including a low-softening-point glass such as $PbO—B_2O_3—SiO_2—Al_2O_3—ZnO—TiO_2$, and a ceramic filler such as alumina.

The conductive pattern 42 is formed by a thick-film forming technique, of an electrically conductive composition including silver (Ag), chromium (Cr) or cupper (Cu) as an electrically conductive material, and has a thickness of about 5–10 μm, for example. The conductive pattern 42 includes a plurality of conductor portions 50 formed on the second partition walls of the core structure 38, extending in a direction perpendicular to the longitudinal direction of the partition walls 22, that is, extending in a direction perpendicular to the longitudinal direction of the individual electrodes 28. The conductor portions 50 have a width of about 50–80 μm, for example.

Each of the conductor portions 50 has a plurality of lugs 52 which are spaced apart from each other in its longitudinal direction (its direction of extension) and which protrude in one of opposite directions parallel to its direction of width, such that the directions of protrusion of the lugs 52 of the adjacent two conductor portions 50 are opposite to each other. Each of the lugs 52 has an end portion 48 covering a part of the corresponding side surface of the partition wall of the dielectric core structure 38. The end portions 48 of the two lugs 52 of the adjacent two conductor portions 50 are opposed to each other, and provide a pair of mutually opposed portion 48 which serve as holding electrodes or scanning electrodes, as described below. Each lug 52 or holding electrode 48 has a width dimension of about 100

μm, for example, in the longitudinal direction of the conductor portion 50, and a height dimension almost equal to the thickness of the grid member 20, that is, a height dimension within a range of about 30–50 μm, for example, 50 μm. Thus, the holding electrodes 48 of the lugs 52 of each conductor portion 50 cover a part of the side surface of the corresponding partition wall of the dielectric core structure 38. In the present embodiment, the conductor portions 50 of the conductor pattern 42 function as internal conductors, and include terminal portions located at the periphery of the front and back plates 12, 14. As shown in FIG. 3, the grid member 20 has a matrix of openings defined by the first and second partition walls of the dielectric core structure 38. One of the two openings which are adjacent to each other in the longitudinal direction of the partition walls 22 is provided with the pair of holding electrodes 48, while the other of the adjacent two opening is not provided with the pair of holding electrodes 48. In this grid member 20, the dimension of the opening provided with the holding electrodes 48 is smaller than that of the opening not provided with the holding electrodes 48, in the longitudinal direction of the partition walls 22 (in the direction perpendicular to the direction of extension of the conductor portions 50).

The covering dielectric layer 44 described above has a thickness within a range of about 10–30 μm, for example, 20 μm, and is formed by a thick-film forming technique of a low-softening-point glass such as $PbO—B_2O_3—SiO_2—Al_2O_3—ZnO—TiO_2$. The covering dielectric layer 44 is provided to store a charge on it surface, for permitting an AC discharge between the holding electrodes 48, and to prevent exposure of the holding electrodes 48, for thereby reducing a change of the atmosphere within the discharge channels 24 due to a gas emitted from the holding electrodes 48.

The protective film 46 also described above has a thickness of about 0.5 μm, for example, and is formed by a thin-film or thick-film forming technique of a composition whose major component is MgO, for example. The protective film 46 is provided to prevent sputtering of the covering dielectric layer 44 due to discharge gas ions. Since the protective film 46 is formed of a dielectric material having a high secondary-emission coefficient, the protective film 46 substantially functions as a discharging electrode.

In the PDP 10 having an electrode arrangement described above, all pairs of the two mutually opposed holding electrodes 48, which pairs are spaced from each other in the longitudinal direction of the conductor portions 50, are sequentially scanned by applying an alternating current pulse to one of the two holding electrodes 48 of each pair, while the selected individual writing electrodes 28 corresponding to the picture elements to be activated according to display data indicative of an image to be displayed are energized with alternating current pulses in synchronization with the scanning operation of the holding electrodes 48. As. a result, a discharge takes places between the energized individual writing electrode 28 and one of the two holding electrodes 48, as indicated by arrow A in FIG. 4, so that a charge is stored in a portion of the protective film 46 that covers the holding electrode 48 in question. After the scanning of all pair of holding electrodes 48 which serve as scanning electrodes, an alternating current pulse is applied to between the holding electrodes 48 of all pairs, so that a potential based on the stored charge is superimposed on a voltage based on the alternating current pulse thus applied, whereby the voltage at the picture element at which the charge has been stored exceeds a discharge-initiating threshold voltage, resulting in the initiation of a discharge between the two opposed holding electrodes 48 of the pair in question, as indicated by three arrows also indicated in FIG. 4. This discharge is maintained for a suitable length of time, owing to a wall charge again produced in the corresponding portion of the protective film 46. Accordingly, the corresponding parts of the fluorescent layer 32 and the fluorescent strip 36 are excited by a ultraviolet radiation generated by the gas discharge, to generate lights at the corresponding picture element. The thus generated lights are emitted through the front plate 12, so that a part of the entire image. The entire image is displayed by sequentially energizing the individual writing electrodes 28 as the holding electrodes 48 are scanned with a predetermined scanning period. It is noted that the cross sectional view of FIG. 4 is taken in a plane parallel to the longitudinal direction of the partition walls 22 of the PDP 10, that is, in a plane perpendicular to the longitudinal direction of the conductor portions 50 of the conductive pattern 42.

When the discharge takes place between the mutually opposed holding electrodes 48, 48, the ultraviolet radiation generated by the discharge propagates beyond the holding electrodes 48 in the longitudinal direction of the discharge channel 24 parallel to the partition walls 22. Accordingly, the parts of the fluorescent layer 32 and fluorescent strip 36 which are located outside the spacing between the holding electrodes 48 are also excited by the ultraviolet radiation, to generate lights. In the present PDP 10, each picture element or cell is defined by the adjacent partition walls 22, in the direction perpendicular to the longitudinal direction of the partition walls 22 (namely, perpendicular to the plane of FIG. 4), and is substantially defined by an area of generation of the ultraviolet radiation, in the longitudinal direction of the partition walls 22 (namely, in the left and right direction as seen in FIG. 4). A center-to-center distance between the adjacent picture elements (pixel pitch or cell pitch) in the PDP 10 is about 3 mm, for example, in both of the longitudinal direction of the partition walls 22 and the longitudinal direction of the conductor portions 50. The present PDP 10 has 64 dots or pixels in both of these two directions.

Figure 5:
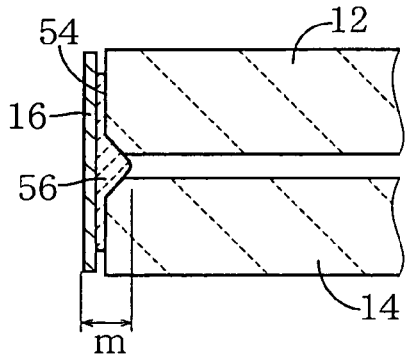
FIG. 5 is a fragmentary cross sectional view illustrating a peripheral sealing portion of the PDP of FIG. 1.

Referring back to FIG. 2, the front plate 12 and the back plate 14 which are spaced from each other are air-tightly sealed along the periphery or perimeter of the PDP 10, to define the air-tight space between the front and back plates 12, 14, by using the metallic tapes 16 bonded to the four end faces of the PDP 10, as described above. FIG. 5 is a fragmentary cross sectional view showing a sealing structure at one end portion of the PDP 10. The metallic tape 16 as shown in FIG. 5 is bonded to one end face 54 of each of the front and back plates 12, 14, with a sealing material 56 being interposed between the metallic tape 16 and the end faces 54. The sealing material 56 is a low-softening-point glass such as $PbO—B_2O_3$, or $ZnO—PbO—B_2O_3$, which has a low softening point within a range of about 350–400° C., for example 400° C. The sealing material 56 has an intermediate portion which fills a peripheral portion of the air-tight space between the front and back plates 12, 14, and front and back end portions interposed between the metallic tape 16 and the end faces 54. In the present PDP 10, the sealing structure has a comparatively small dimension in the direction parallel to the planes of the front and back plates 12, 14. This dimension is a distance "m" indicated in FIG. 5, between the outer surface of the metallic tape 16 and the innermost end of the above-indicated intermediate portion of the sealing material 56. Accordingly, the PDP 10 has a comparatively high ratio of the size of an effective display surface area to its overall external size.

Generally, a degree of air tightness of an air-tight space increases with a sealing depth as represented by a dimension of a mass of a sealing material which fills the peripheral portion of the air-tight space. In the present PDP 10 wherein the sealing material 56 is interposed between the metallic tape 16 and the end faces 54 of the front and back plates 12, 14, the air tightness is determined by not only the above-indicated sealing depth but also a total length of the width-wise opposite end portions of the metallic tape 16, which total length is almost equal to a sum of the thickness values of the front and back plates 12, 14. Namely, the air tightness of the air-tight space between the front and back plates 12, 14 of the present PDP 10 is increased by the presence of the above-indicated front and back end portions of the sealing material 56 interposed between the metallic tape 16 and the end faces 54, in addition to the intermediate portion of the sealing material 56. In this arrangement, therefore, the required sealing depth can be reduced, and the size "m" of the non-display surface area can be reduced, while maintaining the desired degree of air tightness of the air-tight space. Accordingly, the present PDP 10 has an increased ratio of the size of the effective display surface area to the overall external size. Therefore, the use of the present PDP 10 as each of the unitary components of a large-sized tiled flat-panel display device permits this tiled display device to have an accordingly increased ratio of the effective display surface area to the overall external size, so that the tiled flat-panel display device is capable of displaying a large-sized image with high quality, with substantially no visually perceptible seams between the adjacent PDPs 10. Further, the large-sized tiled flat-panel display device can be manufactured at a relatively low cost.

Figure 6:
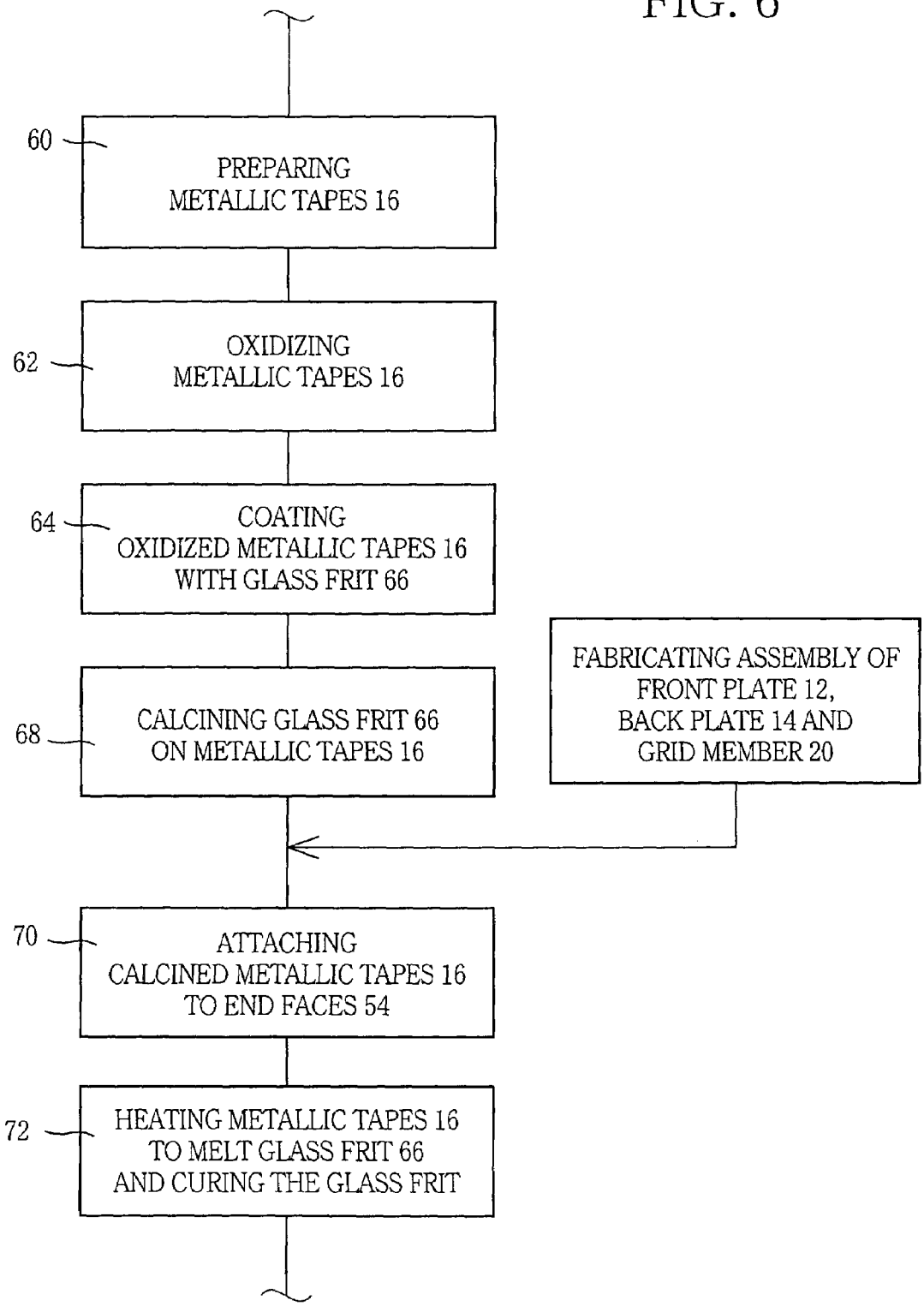
FIG. 6 is a flow chart illustrating a process of sealing the PDP of FIG. 1 along its periphery.

The PDP 10 is manufactured by forming the front plate 12, the back plate 14 and the grid member 20, assembling these members 12, 14, 20 into a pre-cursor of the PDP 10, and sealing the pre-cursor along its perimeter. A process of sealing the assembled pre-cursor of the PDP 10 according to the principle of this embodiment of the invention will be described by reference to the flow chart of FIG. 6 and the perspective views of FIGS. 7A, 7B and 7C.

Figure 7A:
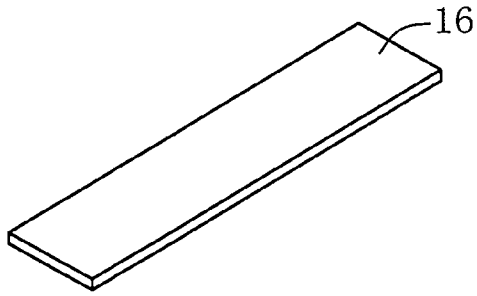
FIGS. 7A, 7B and 7C are perspective views for explaining some of the steps of the sealing process of FIG. 6.
Figure 7B:
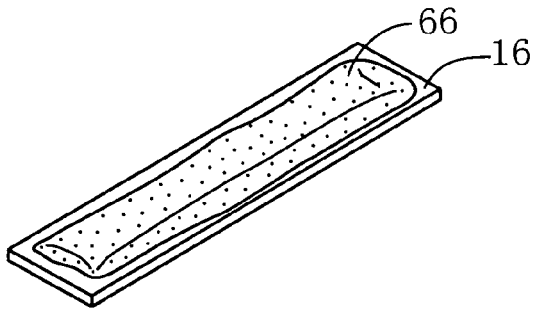

Initially, step 60 is implemented to prepare four metallic tapes 16 (one of which is shown in FIG. 7A), by cutting a sheet formed of an alloy 42-6 (ASTM F31–68), into strips each having predetermined dimensions. In the following step 62, the prepared metallic tapes 16 are subjected to a heat treatment to form oxidized films on the surfaces of the metallic tapes 16. The heat treatment is effected in an atmosphere of hydrogen (H2), at a temperature within a range of 850–1100° C., for example, at 1000° C. Then, step 64 is implemented to coat one of the opposite major surfaces of each oxidized metallic tape 16 with glass frit 66, over the substantially entire area of the surface in question. The glass frit 66 is used to provide the sealing material 54 described above. The metallic tape 16 is coated with the glass frit 66, by a suitable method such as printing, electrodeposition or spraying of the glass frit 66, dipping in a mass of the glass frit 66, or bonding of a tape of the glass frit 66 to the metallic tape 16. In the following step 68, the glass frit 66 applied to the metallic tapes 16 is calcined at a temperature within a range of about 350–500° C., for example, at 450° C., so as to remove a binder from the glass frit 66. FIG. 7B shows the metallic tape 16 coated with the glass frit 66, before or after the step 68. The calcined glass frit 66 has a thickness within a range of about 10–100 μm, for example, 50 μm.

Figure 7C:
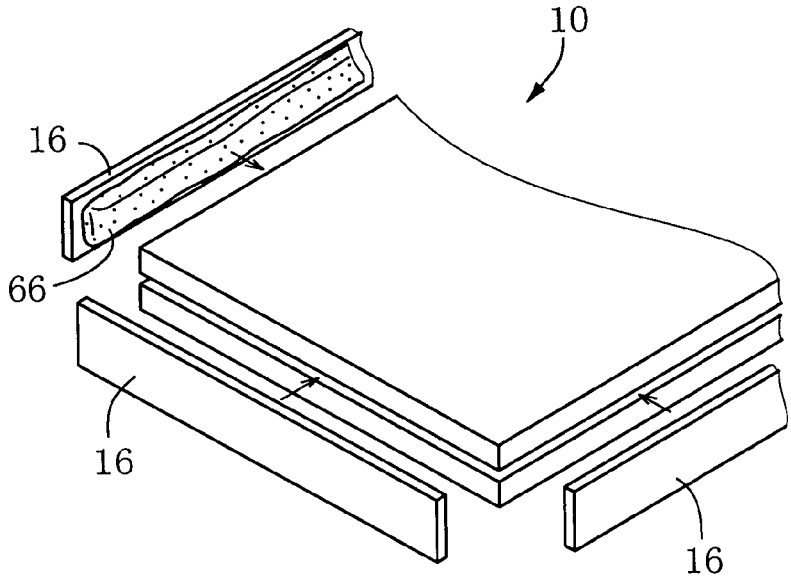

In the following step S70, the metallic tapes 16 are attached under pressure to the respective four end faces of a prepared assembly of the front and back plates 12, 14 and the grid member 20. FIG. 7C shows this step S70. In this step, the metallic tapes 16 are held on the end faces of the assembly, with suitable heat-resistant fastening means, since the glass frit 66 lost its viscosity in the calcining step 68. Since the glass frit 66 is forced onto the end faces of the assembly, the air-tight space between the front and back plates 12, 14 is provisionally closed along its periphery by a portion of the glass frit 66 on the metallic tapes 16. That is, the metallic tapes 16 coated with the glass frit 66 (sealing material 56) are forced onto the end faces 54 of the front and back plates 12, 14, so as to coat the end faces 54 with the glass frit 66. Thus, the operation to apply the glass frit 66 to the end faces 54 and the operation to force the metallic tapes 16 onto the end faces 54 are performed concurrently, in this specific example. The end faces 54 of the assembly 12, 14, 20 (pre-cursor of the PDP 10) may also be coated with a glass frit, before the metallic tapes 16 coated with the glass frit 66 are forced onto the end faces 54. The thickness of this coating of the glass frit on the end faces 54 may be selected within a range of about 10–100 μm, for example, 20 μm, after the coating is dried.

Then, step 72 is implemented to heat the metallic tapes 16 at a suitable temperature selected depending upon the specific composition of the glass frit 66, within a range of about 400–500° C., for example, at 450° C., for softening and fluidizing the glass frit 66 so that the a fluidized mass of the glass frit 66 located near the end faces 54 flows into the peripheral portion of the air-tight space between the front and back plates 12, 14. Subsequently, the metallic tapes 16 and the glass frit 66 are cooled in air, so that the glass frit 66 is cured. Thus, the air-tight space between the front and back plates 12, 14 is sealed by the sealing material 56 in the form of the glass frit 66 which exists not only in the peripheral portion of the air-tight space, but also between the metallic tapes 16 and the end faces 54 of the plates 12, 14, as shown in FIG. 5. The glass frit 66 existing at the above-indicated positions and having a comparatively large sealing length assures a sufficiently high degree of air tightness of the air-tight space of the PDP 10, while minimizing the dimension of the peripheral sealing portion of the PDP 10, that is, the size of the non-display surface area of the PDP 10. Accordingly, the ratio of the effective display surface area of the PDP 10 to its overall external size is significantly increased.

There will next be described other embodiments of this invention. In the following embodiments, the same reference signs as used in the first embodiment described above will be used to identify the functionally corresponding elements or process steps, which will not be described in detail.

Figure 8:
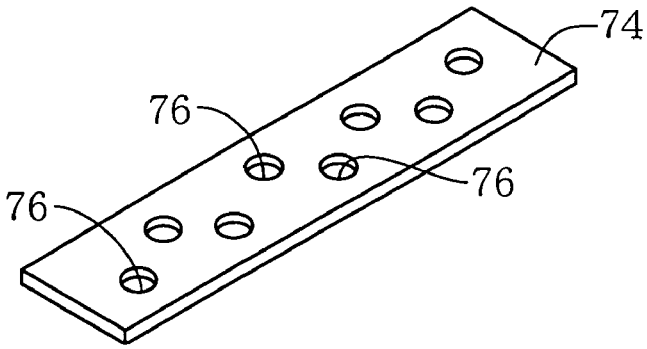
FIG. 8 is a perspective view of a metallic tape used in another embodiment of this invention.

Referring to the perspective view of FIG. 8, there is shown one of metallic tapes 74 used in the second embodiment of the invention, in place of the metallic tapes 16. This metallic tape 74, which is used as a metallic thin sheet, has a plurality or multiplicity of perforations 76 formed therethrough, with a substantially constant distribution over a substantially entire surface area. Like the metallic tapes 16, the metallic tape 74 is formed of an alloy 42-6 (ASTM F31-68), and has dimensions and a shape that are determined depending upon the dimensions of the PDP 10 to be manufactured. For instance, the metallic tape 74 has the same dimensions as the metallic tape 16.

Figure 9A:
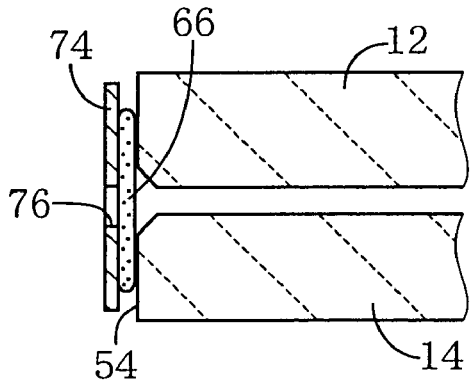
FIGS. 9A and 9B are fragmentary cross sectional views for explaining a sealing process using the metallic tape of FIG. 8.
Figure 9B:
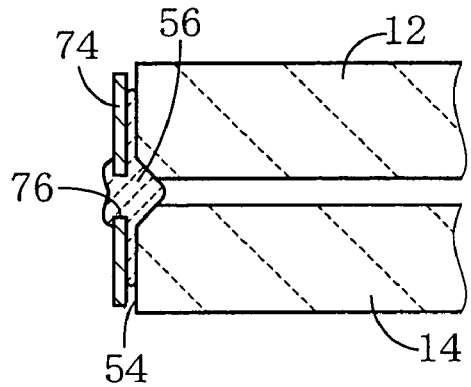

The assembly of the front and back plates 12, 14 and the grid member 20 is sealed along its periphery with the metallic tapes 74, as indicated in the fragmentary cross sectional view of FIGS. 9A and 9B. FIG. 9A shows the metallic tape 74 attached to the end faces 54 of the front and back plates 12, 14, but before the step of heating the metallic tape 74 and the glass frit 66. FIG. 9B shows the metallic tape 74 and the glass frit 66 which have been heated to seal the peripheral portion of the air-tight space of the assembly. In this embodiment, too, each of the metallic tapes 74 is first coated with the glass frit 66 over one of its opposite surfaces, then attached to the end faces 54 with suitable heat-resistant fastening means after calcination of the glass frit 66, and finally subjected to a heating operation wherein a mass of the fluidized glass frit 66 flows into the peripheral portion of the air-tight space while at the same time another mass of the glass frit 66 flows through the perforations 76 formed through the thin metallic tape 74.

In the present second embodiment, therefore, an excess portion of the glass frit 66, if the glass frit 66 is applied to the metallic tape 74 in an excessively large amount, is moved through the perforations 76, so as to stay on the outer surface of the metallic tape 74, so that only a required amount of the sealing material 56 (glass frit 66) exists in the peripheral portion of the air-tight space between the front and back plates 12, 14 and between the metallic tape 74 and the end faces 54. Thus, the use of the metallic tapes 74 having the perforations 76 is effective to prevent an increase in the external size of the PDP 10 due to an excessively large amount of the sealing material 56 between the metallic tapes 74 and the end faces 54. It is noted that the mass of the sealing material 56 (glass frit 66) left on the outer surfaces of the metallic tapes 74 is removed by grinding or any other suitable method, after the metallic tapes 74 and the glass frit 66 are subjected to the heating or firing operation.

Figure 10A:
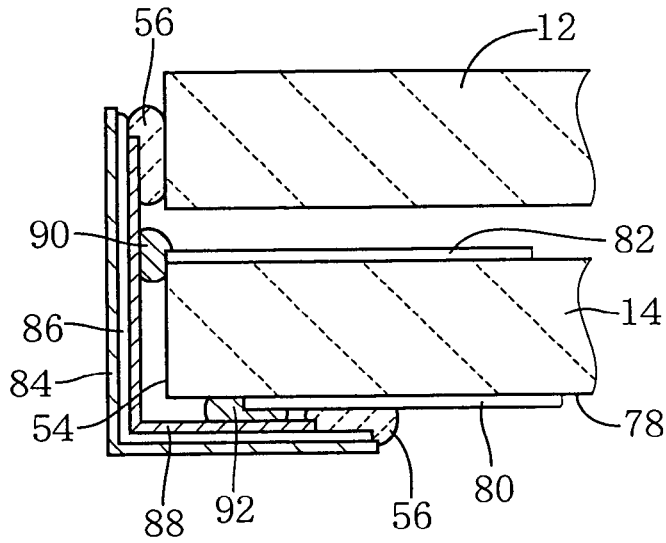
FIG. 10A is a fragmentary cross sectional view of a sealing portion of a PDP according to a further embodiment of the invention.
Figure 10B:
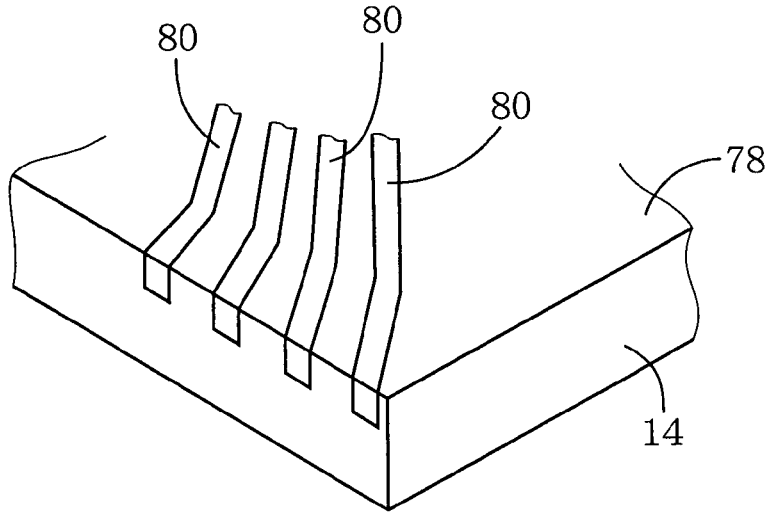
FIG. 10B is a perspective view showing an example of a conductor pattern provided on a back surface of a substrate of the PDP of FIG. 10A.

FIGS. 10A and 10B show a third embodiment of this invention. The fragmentary cross sectional view of FIG. 10A, which corresponds to FIG. 5, shows a sealing structure of a PDP wherein a plurality of external conductors in the form of a conductor pattern 80 are formed on a back surface 78 of the back plate 14, as shown in FIG. 10B, while internal conductors 82 (such as the individual writing electrodes 28 and conductor portion 50 provided in the first embodiment) are provided in the air-tight space and electrically connected to the conductor pattern 80. Although the conductor pattern 80 shown in FIG. 10B extends from the back surface 78 onto the end face 54 of the back plate 14, the conductor pattern 80 may be entirely formed on only the back surface 78, as shown in FIG. 10. Alternatively, the conductor pattern 80 may be formed such that some portion of the conductor pattern 80 is formed on only the back surface 78 while the other portion is formed on not only the back surface 78 but also the end face 54.

Figure 11:
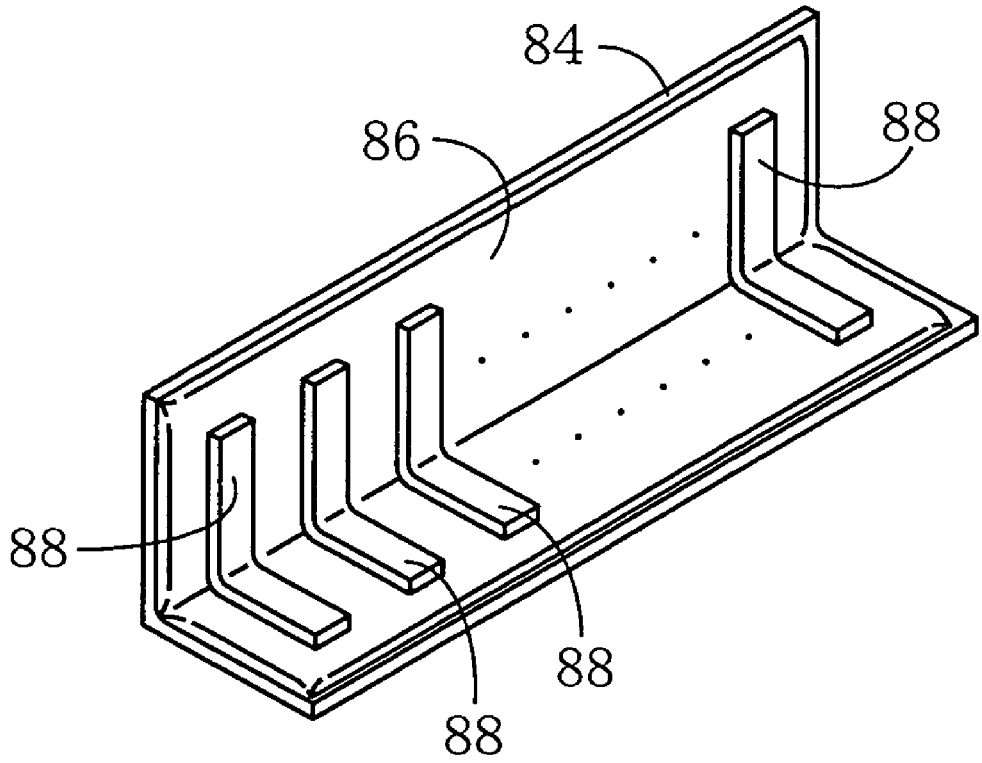
FIG. 11 is a perspective view of a metallic tape used in the embodiment of FIGS. 10A and 10B.

The second embodiment uses a metallic thin sheet in the form of a metallic tape 84 which is L-shaped in transverse cross section, as shown in FIG. 11 and has two portions one of which faces the end faces 54 and the other of which faces the back surface 78. An inner one of the opposite surfaces of the metallic tape 84 which is on the side of the front and back plates 12, 14 is covered by a dielectric layer 86, and is provided with lead conductors 88 in the form of strips bonded to the dielectric layer 88, as shown in FIG. 11. One of the above-indicated two portions of the metallic tape 84 which corresponds to the end faces 54 has a dimension almost equal to the sum of the thickness values of the front and back plates 12, 14, as measured in the direction of thickness of these plates 12, 14 (in the vertical direction as seen in FIG. 10A). The dimension of the other of the two portions in the direction parallel to the back surface 78 is determined depending upon the dimensions and position of the conductor pattern 80 formed on the back surface 78. For example, the dimension of this other portion is about 5 mm. The dielectric layer 86 is formed of a material similar to that of the covering dielectric layer 44 provided in the first embodiment, and has a thickness within a range of about 20–100 μm, for example, about 50 μm. The lead conductors 88 are formed by a thick-film forming technique, of an electrically conductive material such as Ag, Al, Ni, Au and Cu, and has a thickness within a range of about 5–20 μm, for example, about 10 μm.

As shown in the perspective view of FIG. 11, the multiple lead conductors 88 in the form of strips are bonded to the dielectric layer 86 formed on the L-shaped metallic tape 84, such that the lead conductors 88 are parallel to each other and are substantially equally spaced apart from each other in the direction of a straight line about which the metallic tape 84 is bent into the L shape. The dielectric layer 86 is provided to prevent short-circuiting between the lead conductors 88 through the metallic tape 84. Each of the lead conductors 88 is electrically connected to the corresponding internal conductor 82 through an electrically conductive body 90 provided between the end face 54 of the back plate 14 and the lead conductor 88, and to the corresponding portion of the conductor pattern 80 through an electrically conductive body 92 provided between the back surface 78 and the lead conductor 88. The lead conductors 88 are spaced apart from each other by a center-to-center distance equal to that of the internal conductors 82. For instance, the internal conductors 82 are the conductor portions 50 of the conductor pattern 42 (provided in the first embodiment), which are equally spaced from each other by a center-to-center distance of about 1 mm. In this case, the lead conductors 88 are equally spaced from each other by a center-to-center distance of about 1 mm, and have a width of about 300 μm. In the present second embodiment, the internal conductors 82 are electrically connected to the external conductor pattern 80 when the assembly 12, 14, 20 is air-tightly sealed along its periphery with the metallic tapes 84. Thus, the electrical connection is facilitated, and the space required for the electrical connection on the end faces 54 can be minimized.

Figure 12:
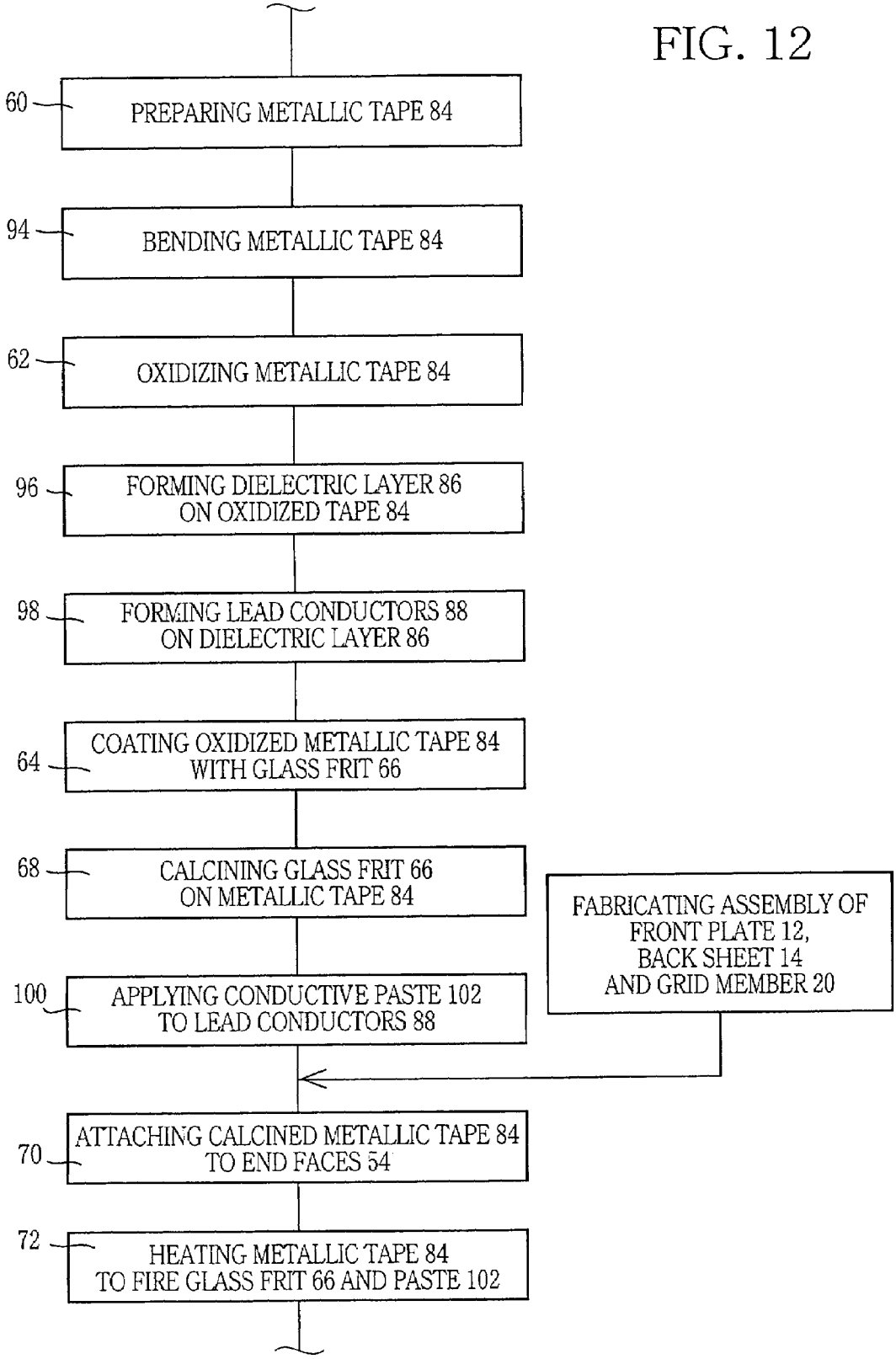
FIG. 12 is a flow chart illustrating a sealing process for obtaining the sealing portion of FIGS. 10A and 10B.
Figure 13A:
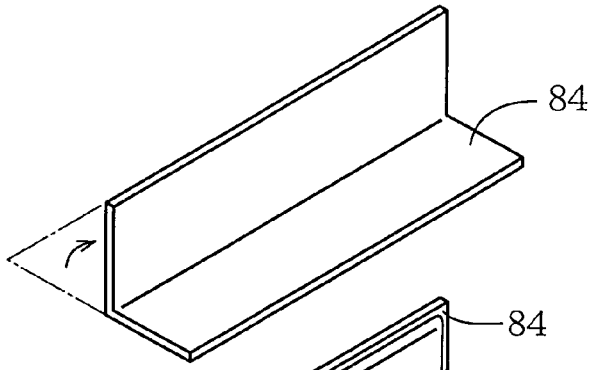
FIGS. 13A, 13B, 13C, 13D and 13E are perspective views for explaining some of the steps of the sealing process of FIG. 12.

The sealing operation using the metallic tapes 84 described above is performed as illustrated in the flow chart of FIG. 12. This sealing operation will be described by reference to FIGS. 13A–13E as well as FIG. 12. The sealing operation is initiated with the step 60 in which the metallic tape 84 is prepared, in the same manner as described above with respect to the first embodiment. Then, step 94 is implemented to bend the metallic tape 84 as shown in FIG. 13A, such that an angle formed inclusively between the above-indicated two portions of the L-shaped metallic tape 84 obtained by the bending operation is about 90°. The bending operation may be performed by a press, for example. The step 94 is followed by the step 62 to oxidize the metallic tape 84 in the same manner described above.

Figure 13B:
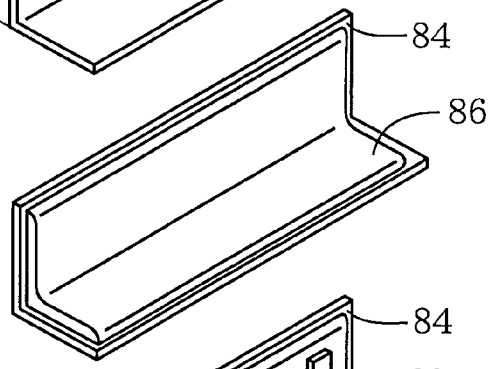

In the following step 96, the dielectric layer 86 is formed on the inner surface of the L-shaped metallic tape 84, as shown in FIG. 13B, by coating the inner surface with a paste of a dielectric material, and firing the paste at a temperature within a range of about 500–600° C., for example, at about 550° C. The dielectric layer 86 may be formed by a suitable method such as spraying, coating with a dispenser, transferring or electrodeposition of the dielectric paste, local dipping in the paste, or bonding of a tape of the paste to the metallic tape 84.

Figure 13C:
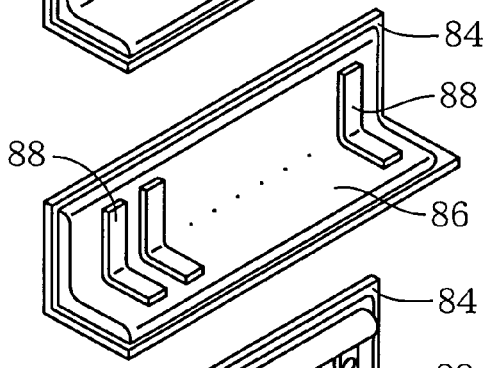

In the next step 98, the lead conductors 88 are formed on the dielectric layer 86, as shown in FIG. 13C, by applying to the dielectric layer 86 a paste of an electrically conductive material including Au in a predetermined pattern of strips, and firing the applied material at a temperature within a range of about 500–600° C., for example, at 550° C. The paste of the electrically conductive material may be applied in the same method as described above with respect to the application of the paste of the dielectric material for the dielectric layer 86. It is noted that the paste of the dielectric material for the dielectric layer 86 and the paste of the electrically conductive material for the lead conductors 88 may be fired simultaneously. The steps 96, 98 to form the dielectric layer 86 and the lead conductors 88 are followed by the steps 64 and 68 to coat the metallic tapes 84 with the glass frit 66 and to calcine the metallic tape 84, as described above.

Figure 13D:
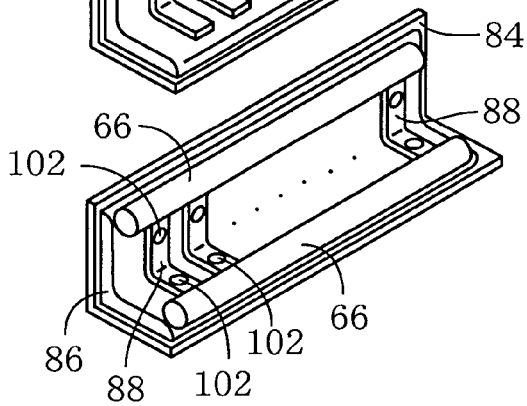
Figure 13E:
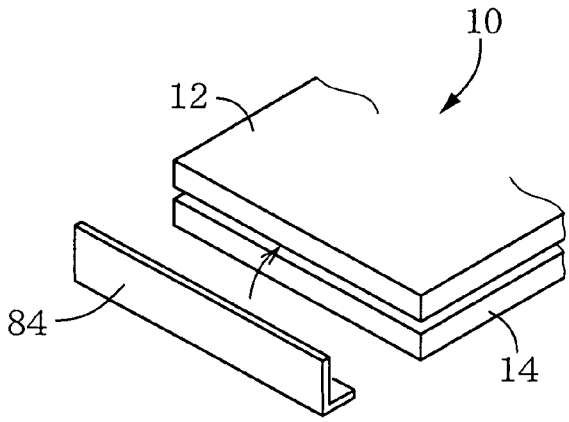

Then, step 100 is implemented to apply masses of a paste 102 of an electrically conductive material to the respective two portions of each lead conductor 88, which two portions correspond to the positions at which the electrically conductive bodies 90, 92 described above are eventually formed, as shown in FIG. 10A. The paste 102 of the electrically conductive material is prepared by dispersing a powder of an electrically conductive material such as Ag in a solvent such as BCA (butyl carbitol acetate), BC (butylenes carbonate) or terpineol. FIG. 13D shows the lead conductors 88 provided with the two masses of the paste 102. The step 100 is followed by the steps 70 and 72 to attach the metallic tape 84 to the end faces 54, as shown in FIG. 13E, and to heat the metallic tape 84 for firing the glass frit 66 to form the sealing material 56 and the paste 102 to form the electrically conductive bodies 90, 92, as shown in FIG. 10A. The L-shaped metallic tape 84 is bonded at its two portions to the end face 54 and the back surface 78 of the back plate 14 through the sealing material 56. Preferably, the paste 102 is prepared so as not to include any resin material, in order to prevent contamination within the PDP 10.

Figure 14:
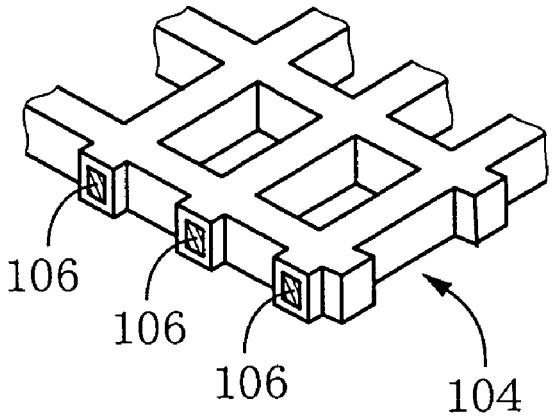
FIG. 14 is a fragmentary perspective view of a grid member formed within a PDP by a thick-film forming technique, in a still further embodiment of the present invention.
Figure 15:
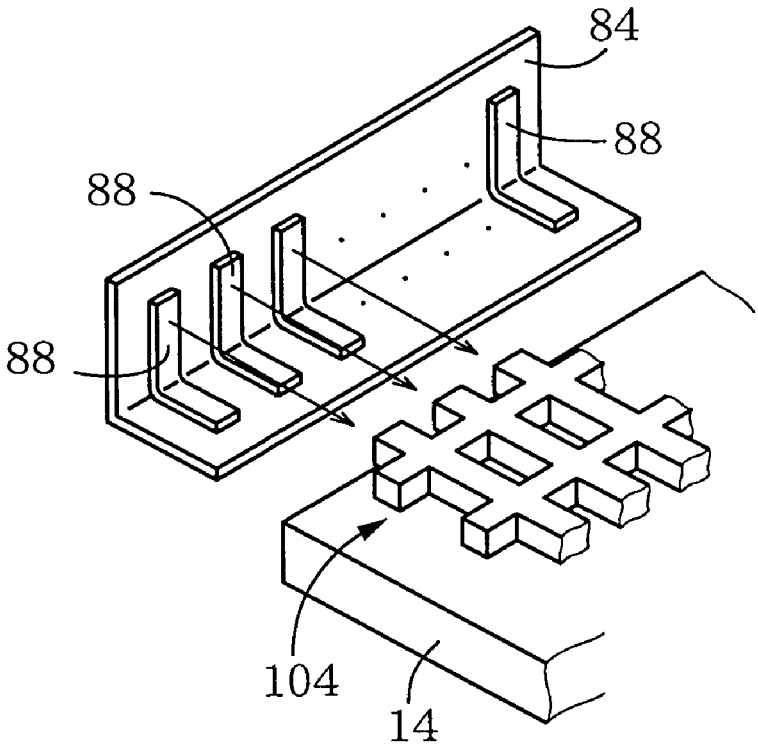
FIG. 15 is a perspective view showing lead conductors of the PDP including the grid member of FIG. 14.

Referring next to the fragmentary perspective view of FIG. 14, there is shown a grid member 104 used in a fourth embodiment of this invention, in place of the grid member 20. The grid member 104 consists of first elongate walls and second elongate walls perpendicular to the first elongate walls, and is provided with conductors 106 each formed in a central portion of an end face of the corresponding first elongate wall. The conductors 106 are covered by the dielectric layer 44 and the protective film 46, which are not shown in FIG. 14. A PDP provided with the grid member 104 is sealed along its periphery, using the L-shaped metallic tape 84, in a manner as shown in FIG. 15. As in the third embodiment, the L-shaped metallic, tape 84 is coated with the dielectric layer 86 for electrical insulation between the metallic tape 84 and the lead conductors 88. However, the dielectric layer 86 is not shown in FIG. 15. The metallic tape 84 is attached to the assembly 12, 14, 104 such that the lead conductors 88 are held in contact with the respective conductors 106 formed on the end faces of the first elongate walls of the grid member 104. The thus attached metallic tape 84 is heated to seal the PDP along its periphery. For improving stability of electrical connection between the conductors 106 and the lead conductors 88, the end faces of the grid member 104 are preferably coated with a slurry or paste of an electrically conductive material such as a powder of Ag, by a suitable method such as coating with a dispenser, dipping in the slurry, transferring of the paste from a film to the metallic tape 84.

Figure 16A:
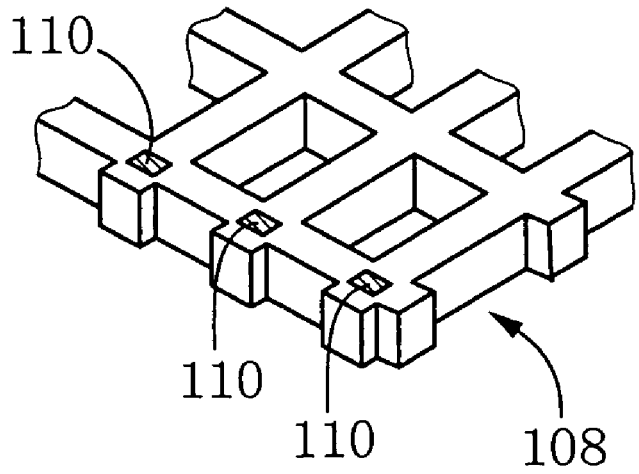
FIG. 16A is a perspective view of a grid member used in place of the grid member of FIG. 14 in a yet further embodiment of this invention.
Figure 16B:
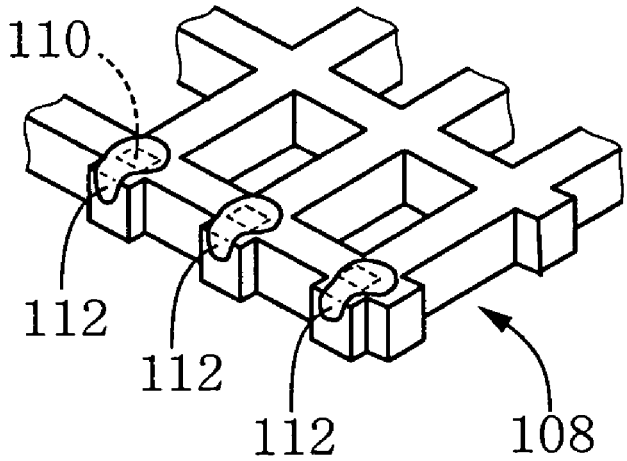
FIG. 16B is a perspective view showing an example of lead conductors partly exposed on an end face of the grid member of FIG. 16A.

Referring to FIGS. 16A and 16B, there is shown a grid member 108 used in a fifth embodiment of this invention. This grid member 108 is provided with conductors 110 formed on its upper surface, rather than on the end faces. Where the grid member 108 is used, the conductors 110 are not electrically connected to the lead conductors 88 by merely attaching the metallic tapes 84 to the end faces 54 of the front and back plates 12, 14 between which the grid member 108 is interposed. In this embodiment, therefore, electrically conductive films 112 are formed on the grid member 108, such that the electrically conductive films 112 cover the conductors 110 and the end faces of the first elongate walls of the grid member 108, as shown in FIG. 16B, so that the lead conductors 88 are held in contact with the electrically conductive films 112, for electrical connection of the conductors 110 with the lead conductors 88. The electrically conductive films 112 are formed by applying to the grid member 108 a slurry or paste of an electrically conductive material similar to that for the conductors 106 formed on the end faces of the grid member 104 of FIG. 14 described above. In this case, the slurry or paste may be applied by using a dispenser, for example. The applied slurry or paste is dried in a suitable manner.

Figure 17:
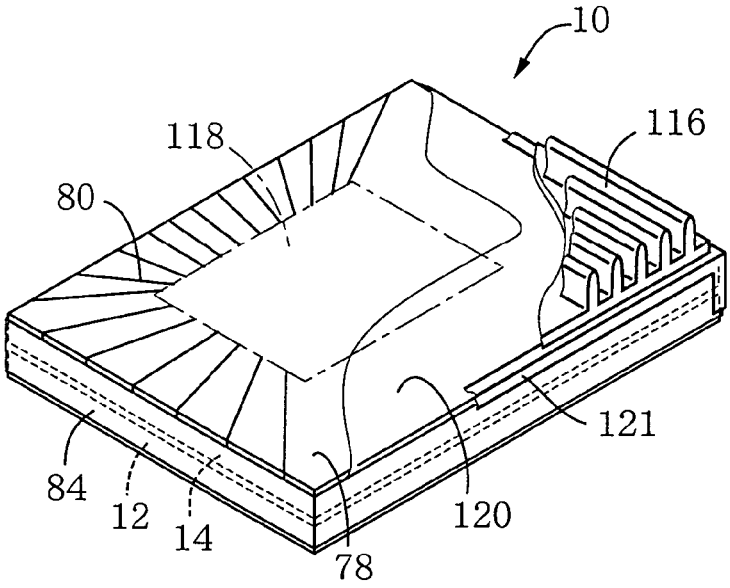
FIG. 17 is a perspective view showing a PDP provided with heat dissipating fins on its back surface, in another embodiment of this invention.

Reference is now made to the perspective view of FIG. 17, which shows the above-indicated PDP 10 to which a heat dissipating member 116 is fixed according to a sixth embodiment of this invention. The PDP 10 is provided with a module portion 118 located at a central portion of the back surface 78. The module portion 118 incorporates semiconductor chips, and the like. The conductor pattern 80 connected to the internal conductors 82 through the lead conductors 88 are connected to the module portion 118. The back surface 78 is covered by a metallic plate 120, which is connected at its periphery to the metallic tapes 84 on the end faces 54. Alternatively, the metallic plate 120 is formed integrally with the metallic tapes 84. Thus, the metallic plate 120 is considered to be a back-surface portion of each metallic tape 84, which includes an end-face portion covering the end faces 54. In FIG. 17, reference numeral 121 denotes a metallic frame used for holding the PDP 10 at a predetermined position when the PDP 10 is used alone, or for holding the PDP 10 in place in a tiled flat-panel display device when the PDP 10 is used as one of unitary components of the tiled display device. The heat dissipating member 116 indicated above is fixed to the frame member 121. That is, when the PDP 10 is fixed to the frame member 121, the heat dissipating member 116 is brought into pressing contact with the metallic plate 120 covering the back surface 78 of the PDP 10. Heat generated during operation of the PDP 10 is transferred to the heat dissipating member 116 through the metallic tapes 84 and the metallic plate 120, and is efficiently dissipated into the ambient air from the heat dissipating member 116, which is provided with a multiplicity of cooling fins.

In the present embodiment wherein the heat dissipating member 116 is fixed to the frame member 121, without direct connection of the heat dissipating member 116 with the back plate 14, the heat dissipating member 116 may be used with the new PDP 10 by which the present PDP 10 has been replaced after its served life. Although the heat dissipating member 116 is not directly connected to the back plate 14, the generated heat can be efficiently dissipated through the heat dissipating member 116 fixed to the frame member 121. In the present embodiment, the frame member 121 is provided with a suitable mechanism to elastically bias the heat dissipating member 116 against the back plate 14, for holding the heat dissipating member 116 in abutting contact with the back plate 14 with a large area of surface contact therebetween.

Figure 18:
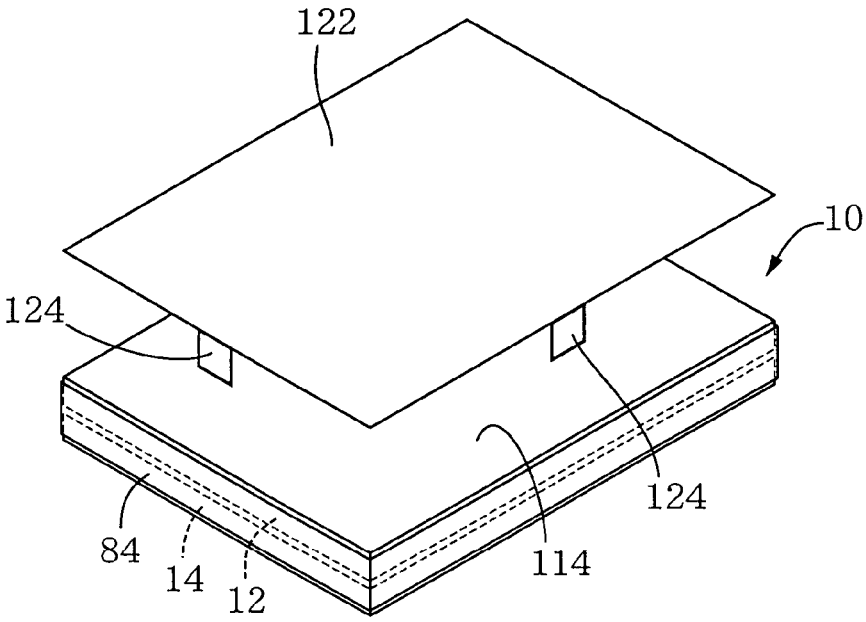
FIG. 18 is a perspective view showing a PDP provided with an electromagnetic wave absorbing film, in a further embodiment of the invention.

The perspective view of FIG. 18 shows an example of an electromagnetic-wave absorbing film 122 fixed to the front plate 12 of the PDP 10, according to a seventh embodiment of this invention. The electromagnetic-wave absorbing film 122 consists of a rectangular mesh of a metallic material, which has a surface area almost similar to that of the front plate 12 and is bonded to a front surface 114 of the front plate 12. The electromagnetic-wave absorbing film 122 bonded to the front plate 12 has four legs 124 extending from the respective four sides toward the back plate 14. These legs 124 are held in pressing contact with the respective four metallic tapes 16 attached to the end faces 54, for electrical connection between the film 122 and the metallic tapes 16 and for grounding of the film 122. The electromagnetic-wave absorbing film 122 may be replaced by a transparent film of an electrically conductive material such as ITO or a metallic material (gold or copper, for example), which covers the front surface 114 as an electromagnetic-wave absorbing film. In this case, the film of the electrically conductive material also covers at least a portion of the end faces 54, or the metallic tapes 16 covers not only the end faces 54 but also a peripheral portion of the film of the electrically conductive material, so that the film is electrically connected to the metallic tapes 16.

Figure 19:
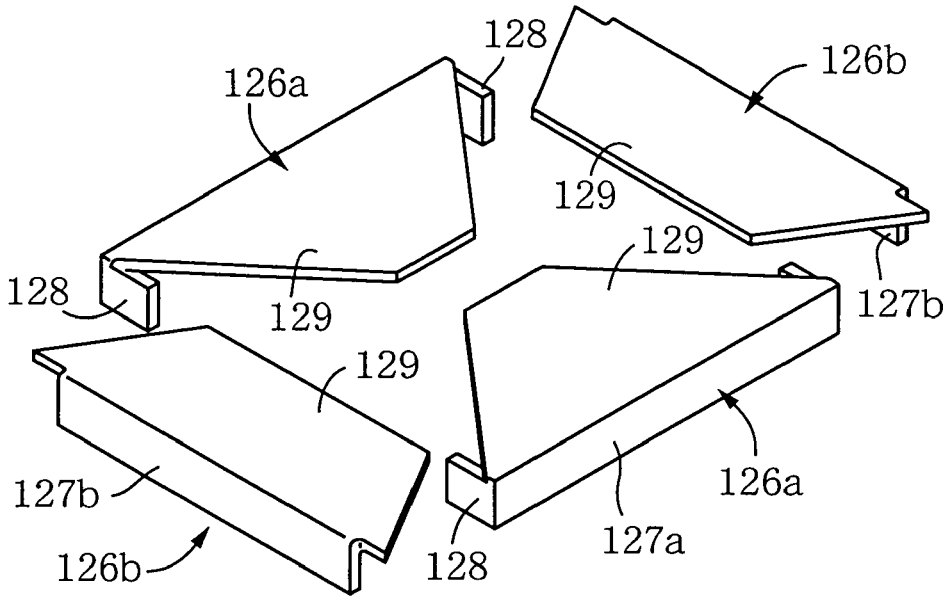
FIG. 19 is a perspective view showing a metallic tape used for a sealing portion in a still further embodiment of the invention.

Referring next to the perspective view of FIG. 19, there is shown a metallic sheet assembly 126 used for sealing a plasma display panel, in a ninth embodiment of the invention. The metallic sheet assembly 126 consists of a pair of first sheet portions 126*a* and a pair of second sheet portions 126*b*. The two first sheet portions 126*a* include respective two tape sections 127*a* functioning as metallic tapes that cover the respective end faces 54 of the front and back plates 12, 14 which are opposed to each other in a first direction, while the two second sheet portions 126*b* include respective two tape sections 127*b* functioning as metallic tapes that cover the other end faces 54 of the plates 12, 14 which are opposed to each other in a second direction perpendicular to the above-indicated first direction. The tape section 127*a* of each first sheet portion 126*a* is provided at its opposite longitudinal ends with respective corner protective lugs 128. Each of the first and second sheet portions 126*a*, 126*b* includes a backing section 129 which is held in contact with the backing surface 78 of the back plate 14, such that the back surface 78 is substantially or almost entirely covered by the backing sections 129 of the four sheet portions 126*a*, 126*b*. When the sheet portions 126*a*, 126*b* are attached to the front and back plates 12, 14, the corner protective lugs 128 of the first sheet portions 126*a* and the end portions of the tape sections 127*b* of the second sheet portions 126*b* are partially superposed on each other, or spaced apart from each other by a relatively small gap left therebetween. For example, a distance of partial superposition or overlapping of the lugs 128 and the tape sections 127*b*, or the above-indicated gap is within a range of about 0.1–1.0 mm. In this embodiment, any gaps left between the first sheet portions 126*a* and the second sheet portions 126*b* are filled with the glass frit 66.

In the present eighth embodiment, the end portions of the end faces 54 at the four corner portions of the front and back plates 12, 14 are covered by the corner protective lugs 128, so that the air tightness at the corner portions is improved than in the first embodiment using the metallic tapes 16, for example. Where a small gap is left between the corner protective lugs 128 and the end portions of the tape sections 127*b*, the gap accommodates some distance of displacement of the metallic sheet assembly 126 due to thermal expansion during heating thereof, relative to the front and back plates 12, 14 which are formed of a glass composition and held substantially stationary. In the present embodiment, the corner protective lugs 128 and the end portions of the tape sections 127*b* have flat end faces, as shown in FIG. 19, each lug 128 and the corresponding end portion of the tape sections 127*b* may be formed to have mutually engageable joint portions in the form of a projection and a recess. This joint is advantageous for improved stability of sealing of the air-tight space.

The metallic sheet assembly 126 may be used in place of the metallic tapes 16 and the metallic plate 120, in the embodiment of FIG. 17 in which the heat dissipating member 116 is fixed to the PDP 10.

Figure 20:
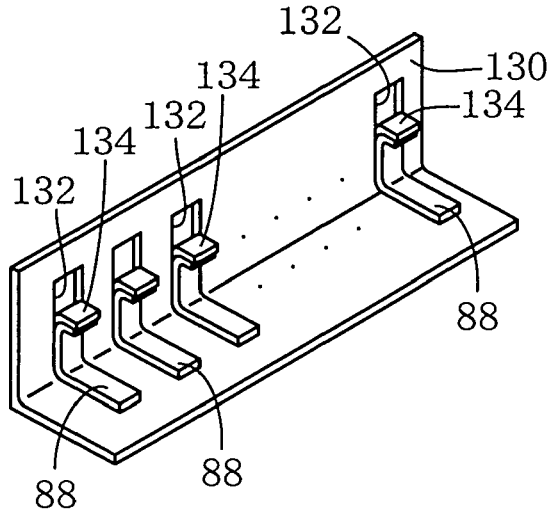
FIG. 20 is a perspective view showing a metallic tape used for a sealing portion in yet another embodiment of the invention.

FIG. 20 shows a metallic thin sheet in the form of a metallic tape 130 used in a ninth embodiment of the invention, in place of the metallic tape 84. Each of the L-shaped lead conductors 88 provided on this metallic tape 130 has one end portion which is bent at an angle of about 90° such that the bent end portion 134 extends toward the end face 54 and is parallel to the other end portion, when the metallic tape 130 is bonded to the end face. Further, a portion of the metallic tape 130 which corresponds to the bent end portion of each lead conductor 88 is partly cut and bent at an angle of about 90°, such that bent portion of the metallic tape 130 is superposed on the bent end portion of the lead conductor 88, and cooperates with this bent end portion to form a projection 134, while a rectangular aperture 132 is formed through the metallic tape 130. The metallic tape 130 is also coated with the dielectric layer 86 (not shown in FIG. 20) on which the lead conductors 88 are provided.

Figure 21:
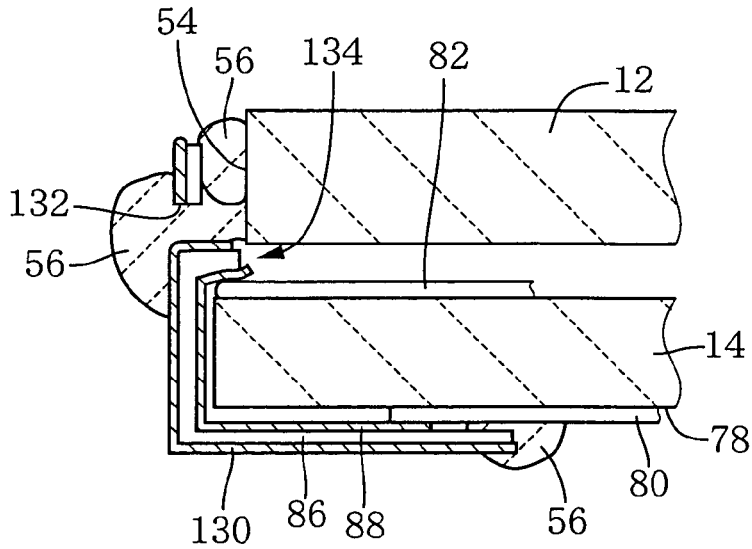
FIG. 21 is a fragmentary cross sectional view showing the sealing portion formed by using the metallic tape of FIG. 20.

The air-tight space between the front and back plates 12, 14 is air-tightly sealed with the metallic tape 130, as shown in the fragmentary cross sectional view of FIG. 21. As indicated in FIG. 21, a distance between the projection 134 at one end portion of the lead conductor 88 and the above-indicated other end portion in the direction of thickness of the back plate 14 is almost equal to the thickness of the back plate 14, so that the projection 134 is held against the end portion of the corresponding internal conductor 82 provided on the inner surface of the back plate 14, while the other end portion of the lead conductor 88 is held in contact with the back surface 78. Further, the metallic plate 130 is air-tightly bonded to the end face 54 of the front plate 12 by the sealing material 56, at an upper end portion of the metallic plate 130, which has the aperture 132 and is located above the projection 134. The metallic tape 130 is also air-tightly bonded at the other end to the back surface 78 of the back plate 14 by the sealing material 56. This sealing arrangement also permits a sufficiently long sealing length while assuring a high ratio of the effective display surface area of the PDP to the overall external size. If necessary, the electrically conductive bodies 90, 92 as provided in the third embodiment of FIG. 9 may be used to improve the electrical continuity between the lead conductors 88 and the internal conductors 82 and the conductor pattern 80.

Figure 22:
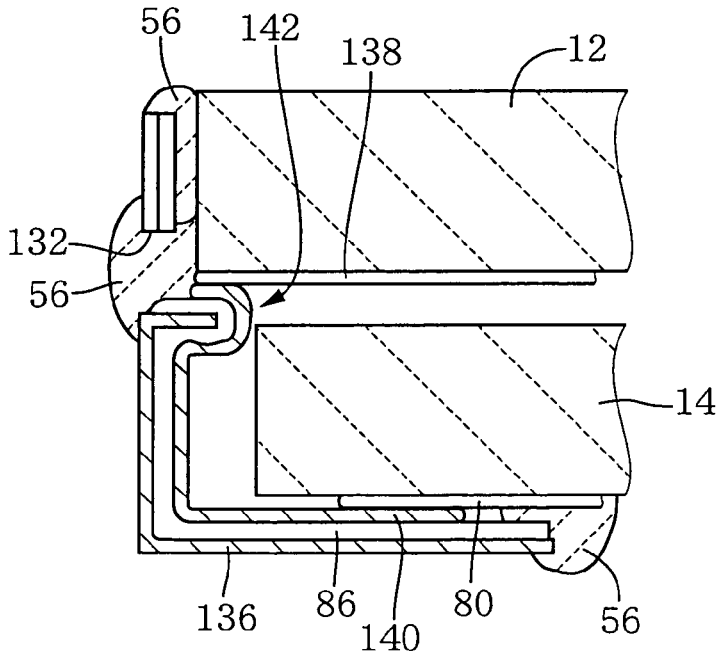
FIG. 22 is a fragmentary cross sectional view showing a metallic tape similar to that of FIG. 20, which is in a PDP wherein internal conductors extend from an inner surface of a front plate to a back surface of a back plate, in still another embodiment of the invention.

Referring to FIG. 22, there is shown a metallic tape 136 which is similar to the metallic tape 130 and which is used in a tenth embodiment of this invention, to seal the air-tight space such that internal conductors 138 formed on the inner surface of the front plate 12 are electrically connected to the conductor pattern 80 formed on the back surface 78 of the back plate 14 through lead conductors 140 provided on the metallic tape 136. Each lead conductor 140 provided on the metallic tape 136 has a bent end portion 142, which partially surrounds the bend end portion of the metallic sheet 136 and at which the lead conductor 140 is electrically connected to the corresponding internal conductor 138. The use of this metallic tape 136 facilitates electrical connection of the internal conductors 138 provided on the front plate 12 with the conductor pattern 80 provided on the back plate 14, when the air-tight space is sealed with the metallic tape 136 and the sealing material 56. The internal conductors 138 may function as holding electrodes in a PDP constructed to effect a so-called "three-electrode surface discharge".

In the ninth embodiment of FIG. 21 using the metallic plate 130, the front and back plates 12, 14 are dimensioned and positioned relative to each other such that the end face 54 of the back plate 14 is spaced from the end face 54 of the front plate 12 in the outward direction of the PDP. IN the tenth embodiment of FIG. 22 using the metallic plate 136, on the other hand, the two plates 12, 14 are dimensioned and positioned relative to each other such that the end face 54 of the front plate 12 is spaced from the end face 54 of the back plate 14 in the outward direction of the PDP. Since the PDP has a rectangular structure having four sides along which the air-tight sealing is effected, it is possible to employ the arrangement of FIG. 21 for the two opposite sides and the arrangement of FIG. 22 for the other two opposite sides, for facilitating the electrical connection of the conductors provided on the front and back plates 12, 14.

Figure 23:
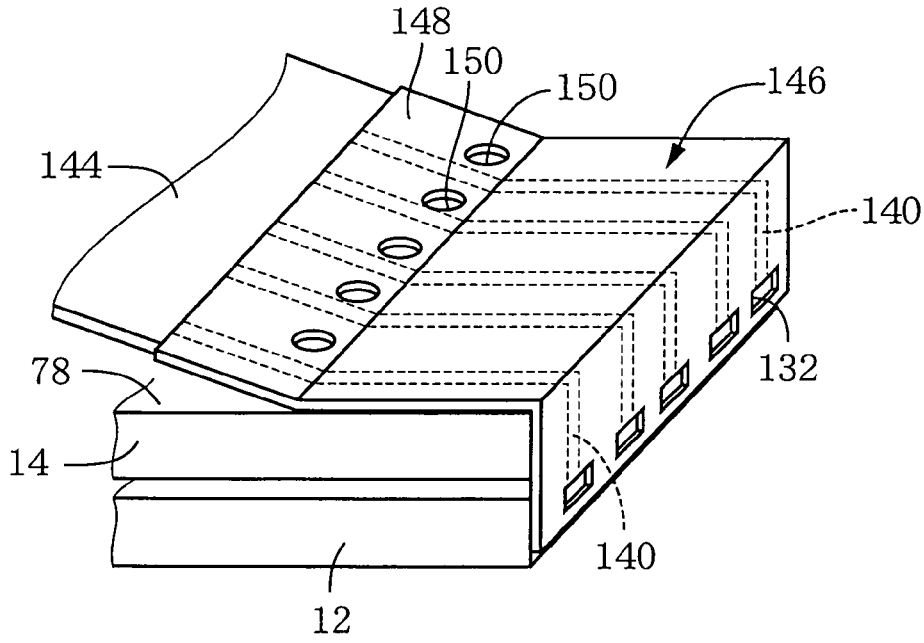
FIG. 23 is a perspective view showing internal conductors electrically connected to a flat cable, in a further embodiment of the invention.
Figure 24:
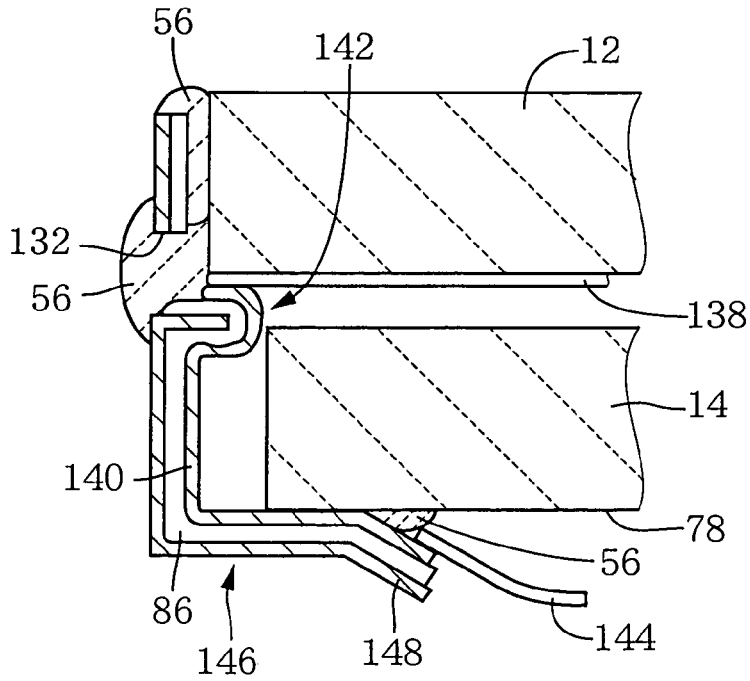
FIG. 24 is a fragmentary cross sectional view of a sealing portion in the embodiment of FIG. 23.

Referring to FIGS. 23 and 24, there is shown the PDP 10 which is connected to an external control circuit (not shown) through a flexible printed circuit (FPC) 144 according to an eleventh embodiment of this invention. This embodiment uses a metallic thin sheet in the form of a metallic tape 146 having an end portion 148 which is attached to the back surface 78 of the back plate 14 and which is bent such that a distance between the bent end portion 148 and the back surface 78 increases as the bent end portion 148 extends inwardly of the back plate 14. The FPC 144 is electrically connected to the inner surface of the bent end portion 148 of the metallic tape 146. The bent end portion 148 has a plurality of perforations 150 such that the perforations 150 are aligned with the respective lead conductors 140. The perforations 150 are provided to improve the air tightness with the sealing material 56 applied to those regions of the bend end portion 148 through which the perforations 150 are formed. The present embodiment facilitates electrical connection of the internal conductors 82, 138 and the conductor pattern 80, and permits a considerably higher the ratio of the effective display surface area of the PDP 10 to the overall external size, than in the embodiments wherein the sealing material is present only at the periphery of the air-tight space.

While the preferred embodiments of the present invention have been described above in detail by reference to the drawings, it is to be understood that the invention may be otherwise embodied.

While the illustrated embodiments of the invention which have been described are applied to the color plasma display panel (PDP 10 of AC type and the process of sealing the PDP 10, the principle of the present invention is equally applicable to any type of flat-panel display device which is sealed along its periphery, irrespective of the specific electrode arrangement. For instance, the present invention is applicable to a monochromatic PDP of AC type, an FED, a SED, a PDP of conventional 3-electrode surface discharge type, and any other type of flat-panel display device which may or may not be provided with a grid member like the grid member 20, 104, 108 used in the illustrated embodiments.

The PDP 10 according to the illustrated embodiments is a full-color display device provided with the fluorescent layers 32 and fluorescent strips 36 corresponding to the primary three colors. However, the principle of this invention is equally applicable to a flat-panel display device provided with fluorescent layers corresponding to one color or two colors, and a flat-panel display device wherein the fluorescent layers are provided on only one of the front and back plates 12, 14.

Although the metallic tapes 16, etc. used in the illustrated embodiments have a thickness within a range of about 50–200 μm, thin metallic sheets having a larger thickness (e.g., about 1 mm) than the metallic tapes may be attached to the end faces 54 of the front and back plates 12, 14 of the PDP 10. The thickness of the thin metallic sheets is determined depending upon the required degree of air tightness of the air-tight space of the display device, the required ease of handling of the sheets, and the tolerable maximum dimension of the non-display surface area of the display device.

In the illustrated embodiments, the metallic tapes 16, etc. are coated with the glass frit 66, and the glass frit 66 is calcined before the metallic tapes are attached to the end faces 54. However, the end faces 54 may be coated with the glass frit 66 before the metallic tapes are attached to the end faces 54.

While the metallic tapes 16, etc. used in the illustrated embodiments are formed of an alloy 42-6 (ASTM F31-68), the metallic tapes may be formed of any other metallic material which has a coefficient of thermal expansion close to that of the material of the front and back plates 12, 14, namely, a glass having a low softening point.

It is to be understood that the present invention may be embodied with various other changes, modifications and improvements, which may occur to those skilled in the art, without departing from the spirit and scope of the invention defined in the appended claims.

What is claimed is:

1. A flat-panel display device comprising:

a transparent first plate and a second plate which are disposed in parallel with each other and cooperate to define therebetween an air-tight space in which light is generated for emission through said first plate;

a sealing material for air-tightly sealing said air-tight space along a periphery of said first and second plates;

metallic thin sheets bonded with said sealing material to end faces of said first and second plates such that said metallic thin sheets cover said end faces;

a plurality of internal conductors disposed between said first and second plates, each of said plurality of internal conductors having one end located near said end faces; and a plurality of lead conductors provided on surfaces of said metallic thin sheets which face said end faces of said first and second plates, said plurality of lead conductors being electrically connected to said internal conductors, respectively, wherein each of said metallic thin sheets has a surface covered by a layer of a dielectric material, and said plurality of lead conductors are strips of an electrically conductive material formed on said layer of the dielectric material.

2. The flat-panel display device according to claim 1, wherein each of said plurality of lead conductors has one end portion which extends in a direction substantially parallel to inner surfaces of said first and second plates, toward inner portions of said first and second plates, said each lead conductor being electrically connected at said one end portion thereof to the corresponding one of said plurality of internal conductors.

3. The flat-panel display device according claim 1, further comprising a plurality of external conductors which are provided on a back surface of said second plate and which are electrically connected to said plurality of lead conductors, respectively.

4. The flat-panel display device according to claim 1, wherein each of said metallic thin sheets is an L-shaped sheet that is L-shaped in transverse cross section and consists of two portions one of which faces said end faces of said first and second plates and the other of which faces a back surface of said second plate, each of said plurality of lead conductors being provided on one surface of said L-shaped sheet and L-shaped following said one surface of said L-shaped sheet.

5. The flat-panel display device according to claim 1, wherein each of said metallic thin sheets includes an end-face portion covering said end faces of said first and second plates, and a back-surface portion which extends from said end-face portion and covers a back surface of said second plate, said back-surface portion being provided for pressing contact with a heat dissipating member fixed to a frame member when the flat-panel display device is attached to the frame member.

6. The flat-panel display device according to claim 1, further comprising an electromagnetic-wave absorbing film which is formed on a front surface of said first plate and which is connected at a peripheral portion thereof to said metallic thin sheets.

7. The flat-panel display device according to claim 1, which is used as each of unitary components of a large-sized tiled display device wherein a plurality of flat-panel display devices are arranged to provide a single flat display surface.

8. A flat-panel display device comprising:

a transparent first plate and a second plate which are disposed in parallel with each other and cooperate to define therebetween an air-tight space in which light is generated for emission through said first plate;

a sealing material for air-tightly sealing said air-tight space along a periphery of said first and second plates;

metallic thin sheets bonded with said sealing material to end faces of said first and second plates such that said metallic thin sheets cover said end faces;

a plurality of internal conductors disposed between said first and second plates, each of said plurality of internal conductors having one end located near said end faces;

a plurality of lead conductors provided on surfaces of said metallic thin sheets which face said end faces of said first and second plates, said plurality of lead conductors being electrically connected to said internal conductors, respectively; and a plurality of external conductors which are provided on a back surface of said second plate and which are electrically connected to said plurality of lead conductors, respectively.

9. The flat-panel display device according to claim 8, wherein each of said plurality of lead conductors has one end portion which extends in a direction substantially parallel to inner surfaces of said first and second plates, toward inner portions of said first and second plates, said each lead conductor being electrically connected at said one end portion thereof to the corresponding one of said plurality of internal conductors.

10. The flat-panel display device according to claim 8, wherein each of said metallic thin sheets is an L-shaped sheet that is L-shaped in transverse cross section and consists of two portions one of which faces said end faces of said first and second plates and the other of which faces a back surface of said second plate, each of said plurality of lead conductors being provided on one surface of said L-shaped sheet and L-shaped following said one surface of said L-shaped sheet.

11. The flat-panel display device according to claim 8, wherein each of said metallic thin sheets includes an end-face portion covering said end faces of said first and second plates, and a back-surface portion which extends from said end-face portion and covers a back surface of said second plate, said back-surface portion being provided for pressing contact with a heat dissipating member fixed to a frame member when the flat-panel display device is attached to the frame member.

12. The flat-panel display device according to claim 8, further comprising an electromagnetic-wave absorbing film which is formed on a front surface of said first plate and which is connected at a peripheral portion thereof to said metallic thin sheets.

13. The flat-panel display device according to claim 8, which is used as each of unitary components of a large-sized tiled display device wherein a plurality of flat-panel display devices are arranged to provide a single flat display surface.

14. A flat-panel display device comprising:

a transparent first plate and a second plate which are disposed in parallel with each other and cooperate to define therebetween an air-tight space in which light is generated for emission through said first plate;

a sealing material for air-tightly sealing said air-tight space along a periphery of said first and second plates;

metallic thin sheets bonded with said sealing material to end faces of said first and second plates such that said metallic thin sheets cover said end faces;

a plurality of internal conductors disposed between said first and second plates, each of said plurality of internal conductors having one end located near said end faces; and a plurality of lead conductors provided on surfaces of said metallic thin sheets which face said end faces of said first and second plates, said plurality of lead conductors being electrically connected to said internal conductors, respectively, wherein each of said metallic thin sheets is an L-shaped sheet that is L-shaped in transverse cross section and consists of two portions one of which faces said end faces of said first and second plates and the other of which faces a back surface of said second plate, each of said plurality of lead conductors being provided on one surface of said L-shaped sheet and L-shaped following said one surface of said L-shaped sheet.

15. The flat-panel display device according to claim 14, wherein each of said plurality of lead conductors has one end portion which extends in a direction substantially parallel to inner surfaces of said first and second plates, toward inner portions of said first and second plates, said each lead conductor being electrically connected at said one end portion thereof to the corresponding one of said plurality of internal conductors.

16. The flat-panel display device according to claim 14, wherein each of said metallic thin sheets includes an end-face portion covering said end faces of said first and second plates, and a back-surface portion which extends from said end-face portion and covers a back surface of said second plate, said back-surface portion being provided for pressing contact with a heat dissipating member fixed to a frame member when the flat-panel display device is attached to the frame member.

17. The flat-panel display device according to claim 14, further comprising an electromagnetic-wave absorbing film which is formed on a front surface of said first plate and which is connected at a peripheral portion thereof to said metallic thin sheets.

18. The flat-panel display device according to claim 14, which is used as each of unitary components of a large-sized tiled display device wherein a plurality of flat-panel display devices are arranged to provide a single flat display surface.

* * * * *